US007387522B2

(12) United States Patent
Janos et al.

(10) Patent No.: US 7,387,522 B2
(45) Date of Patent: Jun. 17, 2008

(54) BAYONET CONNECTION FOR KNOCK-DOWN FIXTURES AND PORTABLES

(75) Inventors: Joseph John Janos, Wadsworth, OH (US); Gregory Stergiou, Geneva Township, OH (US); Richard A. Williams, Akron, OH (US); Raymond J. Fritz, Northfield, OH (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 11/470,411

(22) Filed: Sep. 6, 2006

(65) Prior Publication Data

US 2007/0117462 A1 May 24, 2007

Related U.S. Application Data

(60) Provisional application No. 60/714,432, filed on Sep. 6, 2005.

(51) Int. Cl.
*H01R 13/213* (2006.01)

(52) U.S. Cl. ..... 439/314; 439/18; 439/953

(58) Field of Classification Search ..... 439/310–314, 439/660, 675, 953, 18–21; 362/404–406
See application file for complete search history.

(56) References Cited

U.S. PATENT DOCUMENTS

| | | | |
|---|---|---|---|
| 025,155 | A | 12/1881 | Edison |
| 0,897,947 | A | 9/1908 | Wilson |
| 0,922,490 | A | 5/1909 | Levison |
| 0,993,713 | A | 5/1911 | Philips |
| 1,016,317 | A | 2/1912 | Benjamin |
| 1,017,694 | A | 2/1912 | Sechrist |
| 1,035,061 | A | 8/1912 | Trood |
| 1,045,273 | A | 11/1912 | Fisher |
| 1,059,441 | A | 4/1913 | Crowell |
| 1,059,742 | A | 4/1913 | Lumley |
| 1,062,619 | A | 5/1913 | Trood |
| 1,129,982 | A | 3/1915 | Hotchkin |
| 1,170,352 | A | 2/1916 | Sheward |
| 1,247,376 | A | 11/1917 | Clarke |

(Continued)

*Primary Examiner*—Khiem Nguyen
(74) *Attorney, Agent, or Firm*—Calfee, Halter & Griswold LLP

(57) ABSTRACT

Arrangements and methods are provided for electrically and mechanically coupling a lighting arm to a wiring body. An exemplary arrangement includes a fixture arm, a wiring body, a socket, and a plug. The exemplary socket is affixed to one of the fixture arm and the wiring body, and includes a socket opening and at least one socket electrical contact. The exemplary socket opening includes an outer end, an inner end, and a first mating portion on an internal surface of the socket opening. The exemplary plug is affixed to the other of the fixture arm and the wiring body, and includes a plug body and at least one plug electrical contact. The exemplary plug body includes an end portion, a side portion, and a second mating portion disposed on the side portion. The second mating portion is configured to engage the first mating portion when the plug is coupled with the socket. When the plug is inserted in the socket, the plug and the socket are configured such that the plug is rotatable from an inserted position to a retained position in which the at least one plug electrical contact engages the at least one socket electrical contact and the first mating portion is retained in engagement with the second mating portion.

26 Claims, 17 Drawing Sheets

U.S. PATENT DOCUMENTS 1,488,658 A 4/1924 Williamson
1,502,461 A 7/1924 Cooper
1,534,662 A 4/1925 Riddle
1,572,728 A 2/1926 Kestell
1,575,168 A 3/1926 Kestell
1,646,495 A 10/1927 Samuelson
1,658,206 A 2/1928 Matthyssen
1,668,772 A 5/1928 Kestell
1,680,094 A 8/1928 Doane
1,741,408 A 12/1929 Doane et al.
1,762,526 A 6/1930 Riddle
1,796,330 A 3/1931 Hotchkin
2,279,034 A 4/1942 Elting
2,804,542 A 8/1957 Siegel
3,387,129 A 6/1968 Weber et al.
3,465,282 A 9/1969 Berges et al.
3,622,779 A 11/1971 Lagin
3,735,123 A 5/1973 Porter et al.
3,735,329 A 5/1973 Funabashi et al.
3,979,584 A 9/1976 Fossati
4,034,216 A 7/1977 Webster et al.
4,079,244 A 3/1978 Bortoluzzi
4,107,770 A 8/1978 Weber
4,477,866 A 10/1984 Goralnik
4,748,549 A 5/1988 Scheer
5,255,173 A 10/1993 Schonbek
5,258,900 A 11/1993 Bayer
5,519,594 A 5/1996 Wu
5,873,652 A 2/1999 Bayer et al.
6,123,578 A 9/2000 Truett
6,283,619 B1 9/2001 Pulaski et al.
6,371,632 B1 4/2002 Lavy
6,422,722 B1 7/2002 Voltolina
6,441,302 B1 8/2002 Wu
6,455,775 B1 9/2002 Wu
6,474,847 B1 11/2002 Wu
6,489,560 B1 12/2002 Wu
6,502,966 B1 1/2003 Wu
6,517,223 B2 2/2003 Hsu
6,530,682 B2 3/2003 Wu
6,565,240 B1 5/2003 Wu
6,589,075 B1 7/2003 Wu
6,600,102 B1 7/2003 Wu
6,612,531 B2 9/2003 Wu
6,617,513 B1 9/2003 Wu
6,638,074 B1 * 10/2003 Fisher ..... 439/22
6,639,149 B1 10/2003 Wu
6,653,560 B1 11/2003 Wu
6,655,816 B2 12/2003 Wu
6,666,613 B2 12/2003 Wu
6,669,395 B2 12/2003 Wu
6,676,326 B2 1/2004 Wu
6,679,647 B2 1/2004 Hixon
6,682,303 B2 1/2004 Wu
6,685,346 B2 2/2004 Wu
6,692,140 B2 2/2004 Wu
6,692,180 B2 2/2004 Wu
6,695,464 B1 2/2004 Wu
6,695,643 B2 2/2004 Wu
6,712,491 B1 2/2004 Wu
6,715,899 B1 4/2004 Wu
6,715,906 B1 4/2004 Wu
6,719,531 B2 4/2004 Wu
6,733,159 B1 5/2004 Wu
6,743,978 B2 6/2004 Wu
6,746,145 B1 6/2004 Wu
6,758,577 B2 7/2004 Wu
6,761,469 B2 7/2004 Wu
6,773,306 B2 * 8/2004 Plishner ..... 439/620.15
6,780,050 B1 8/2004 Wu
6,793,378 B2 9/2004 Wu
6,793,383 B2 9/2004 Wu
6,793,525 B2 9/2004 Wu
6,796,827 B1 9/2004 Chen
6,805,477 B1 10/2004 Wu
6,827,603 B1 12/2004 Lin
6,831,418 B1 12/2004 Wu
6,840,651 B2 1/2005 Wu
6,851,829 B2 2/2005 Wu
6,851,830 B2 2/2005 Wu
6,854,867 B2 2/2005 Mas Quiles et al.
6,854,868 B2 2/2005 Wu
6,860,630 B2 3/2005 Wu
6,874,916 B2 4/2005 Wu
6,877,884 B2 4/2005 Wu
6,899,447 B2 5/2005 Wu
6,918,686 B2 7/2005 Wu
6,926,424 B2 8/2005 Wu
6,932,501 B2 8/2005 Wu
6,948,833 B2 9/2005 Wu
2003/0138291 A1 7/2003 Hixon
2003/0139092 A1 7/2003 Wu
2004/0008518 A1 1/2004 Wu et al.
2004/0022062 A1 2/2004 Wu
2004/0052074 A1 3/2004 Wu
2004/0080955 A1 4/2004 Wu
2004/0174711 A1 9/2004 Wu
2004/0190297 A1 9/2004 Wu
2004/0190306 A1 9/2004 Wu
2004/0200944 A1 10/2004 Wu et al.
2004/0201986 A1 10/2004 Wu
2004/0213002 A1 10/2004 Wu
2004/0246708 A1 12/2004 Wu
2004/0246729 A1 12/2004 Wu
2005/0024883 A1 2/2005 Wu
2005/0042917 A1 2/2005 Wu

* cited by examiner

BAYONET CONNECTION FOR KNOCK-DOWN FIXTURES AND PORTABLES

CROSS-REFERENCE TO RELATED APPLICATIONS

This application claims priority to, and any other benefit of, U.S. Provisional Application Ser. No. 60/714,432, filed on Sep. 6, 2005, and entitled BAYONET CONNECTION FOR KNOCK-DOWN ("KD") FIXTURES, the disclosure of which is hereby incorporated by reference in its entirety.

FIELD OF THE INVENTION

The present invention relates generally to electrical fixtures and portables, and more particularly to a bayonet connection to connect the arms of a knock-down ("KD") lighting fixture or portable to a wiring body.

BACKGROUND OF THE INVENTION

So-called "knock-down" (or "KD") lighting fixtures, i.e., fixtures that can be made more compact for storage and shipment, are known. See, for example, U.S. Pat. No. 3,831,022. It is also known to ship fixtures having one or more arms removed with the understanding that an installer or consumer would connect the arms to a wiring body. See, for example, Wu U.S. Pat. No. 6,840,651.

SUMMARY OF THE INVENTION

According to an inventive aspect of the present application, an arrangement is provided for electrically and mechanically coupling a fixture arm to a wiring body. The arrangement includes a fixture arm, a wiring body, a socket, and a plug. The socket is affixed to one of the fixture arm and the wiring body, and includes a socket opening and at least one socket electrical contact. The socket opening includes an outer end, an inner end, and a first mating portion on an internal surface of the socket opening. The plug is affixed to the other of the fixture arm and the wiring body, and includes a plug body and at least one plug electrical contact. The plug body includes an end portion, a side portion, and a second mating portion disposed on the side portion. The second mating portion is configured to engage the first mating portion when the plug is coupled with the socket. When the plug is inserted in the socket, the plug and the socket are configured such that the plug is rotatable from an inserted position to a retained position in which the at least one plug electrical contact engages the at least one socket electrical contact and the first mating portion is retained in engagement with the second mating portion.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention, wherein:

(FIG. 14B is an exploded view) of an exemplary two-piece electrical contact retainer;

DETAILED DESCRIPTION OF THE INVENTION

The present application relates to arrangements for electrically and mechanically connecting wiring bodies and extensions or arms of many different types of assemblies, including, for example, lighting fixtures and lighting portables. While the exemplary embodiments described herein refer to wiring bodies and fixture arms for a lighting fixture, such as a chandelier, the described inventive aspects may be applied to any assembly including an electrical base or wiring body that is electrically and mechanically connectable to one or more extensions or arms to supply electricity to, or receive electricity from, the extensions. In one embodiment, these electrical and mechanical connections may be achieved by inserting a plug affixed to one of the arm and the wiring body into a socket affixed to the other of the arm and the wiring body, and rotating or twisting the plug from an inserted position to a retained position in which a mechanical and an electrical connection between the plug and the socket is maintained. This "twist-lock" or bayonet type connection may provide a rigid and durable connection between the wiring body and the fixture arm, while allowing for quick disassembly of the fixture arm from the wiring body, for example, to save space when storing or shipping the assembly.

Figure 1:
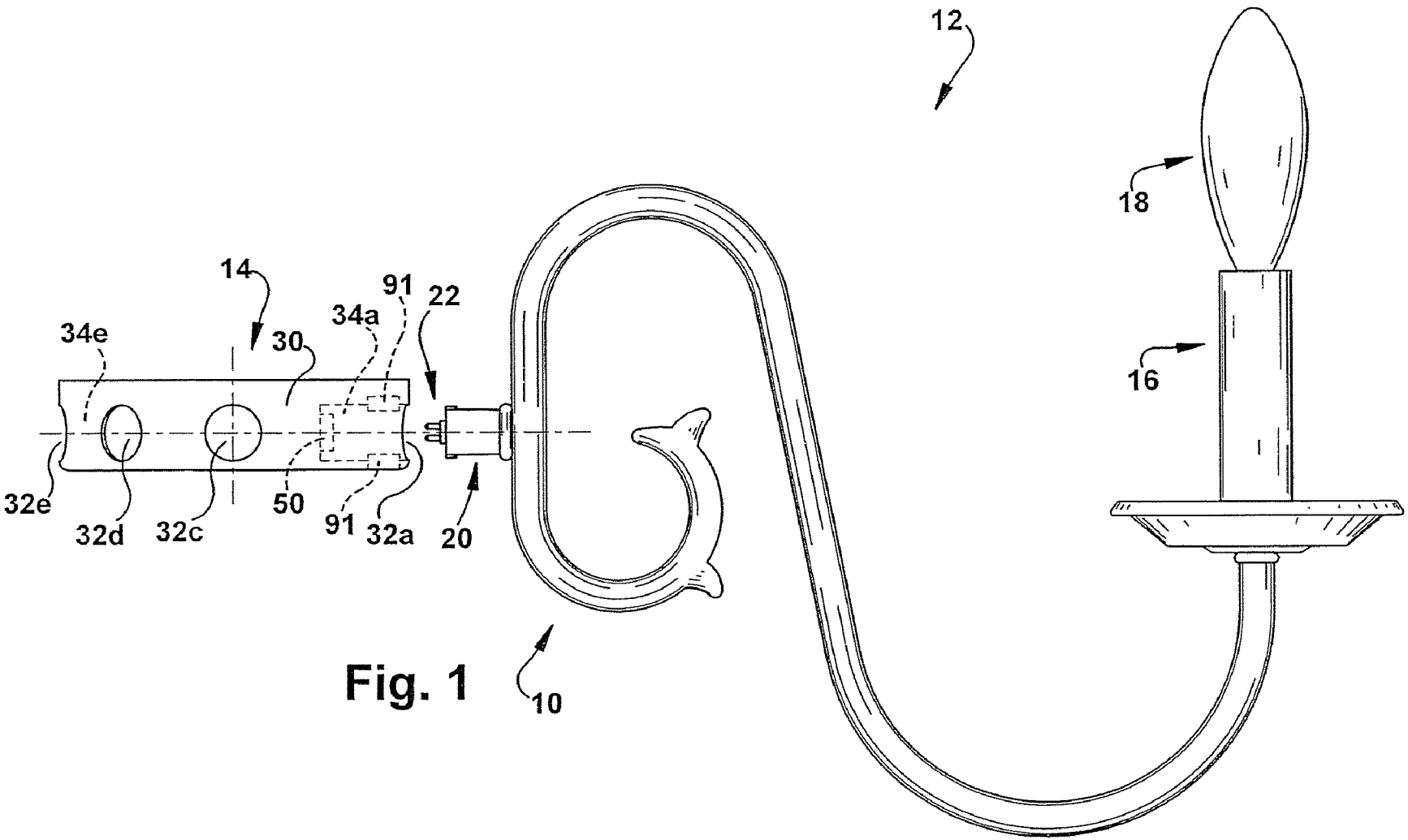
FIG. 1 is a side schematic view of an exemplary arm and an exemplary wiring body.
Figure 2:
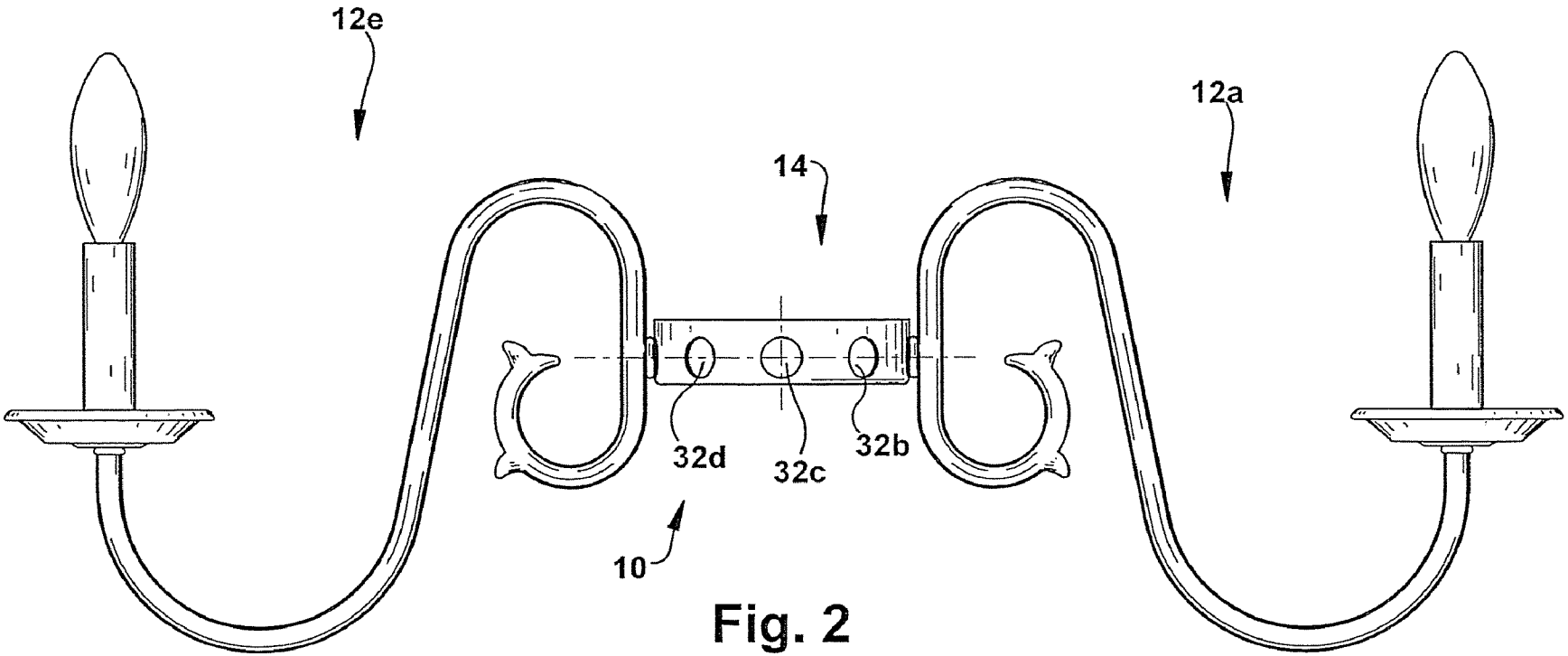
FIG. 2 is a side schematic view of a pair of exemplary arms installed in an exemplary wiring body.

Referring now to the drawings, FIGS. 1 and 2 show a partially schematic view of an exemplary fixture 10 having an exemplary fixture arm 12 for connection to an exemplary wiring body 14. In an exemplary embodiment, the arm may carry a light socket 16 that receives a light bulb 18 or other source of illumination. In other exemplary assemblies, the arm may be configured to attach to other electrically powered devices or components, by way of an electrical outlet or other such connection, or by providing the device or component, such as, for example, a light emitting diode (LED), integral with the fixture arm.

To provide a bayonet type connection between the wiring body and the fixture arm, either the wiring body or the fixture arm may be provided with a socket, with the other of the wiring body and fixture arm being provided with a plug configured to couple with the socket. The exemplary arm 12 of the embodiment of FIGS. 1 and 2 carries a bayonet type plug 20, while the exemplary wiring body carries a corresponding socket 34. The plug 20 may provide both an electrical connection from the arm 12 to the wiring body 14 and a mechanical connection of the arm 12 to the wiring body 14. The arm 12 may be hollow for carrying electrical wiring from the plug 20 to the light socket 16. The exemplary wiring body 14 carries electrical wiring (e.g., wiring shown in FIGS. 4, 5A-5E, 6, 8, and 11) to electrically connect the light socket 16 of the fixture 10 to a source of electrical power (not shown). The wiring body 14 may be, for example, suspended from a ceiling, mounted to a wall, or mounted to a post (all not shown). The wiring body 14 has a housing 30 and a corresponding opening 32 in the housing 30 to accept a plug 20 for each fixture arm 12. Each opening 32 has a corresponding socket 34 to provide an electrical connection and a mechanical connection between the arm 12 and the wiring body 14. The socket 34 has a socket housing 36 (FIGS. 3-11). The specific configuration of the arm 12 and wiring body 14 are not important; fixture arms and wiring bodies may have numerous different lengths, widths, shapes, aspect ratios, designs, etc. Additionally, arms according to the present invention may connect to the wiring body 14 at virtually any location of the wiring body (sides, top, bottom, or any combination or permutation thereof).

According to another inventive aspect of the present application, as illustrated in FIG. 1, a mechanical connection between a fixture arm and a wiring body may be accomplished using a plug and socket connection. A first mating portion, shown schematically at 91, is disposed on an internal surface of the socket opening and a second mating portion, shown schematically at 41 is disposed on an outer or side portion of the corresponding plug 20. The first and second mating portions 91, 41 are configured to engage each other when the plug 20 is inserted in the socket opening 32 and rotated from an inserted position to a retained position. This bayonet type connection between the plug 20 and socket 34 may be achieved by many different types of mating portions 91, 41, such as, for example, a projection on one of the plug and the socket configured to be received in a corresponding channel or detent in the other of the plug and the socket, corresponding flexing or camming surfaces on the plug and the socket, or corresponding latching components on the plug and the socket. Further, one or both of the plug 20 and the socket 34 may include a spring loaded mechanism to bias the plug and socket connection into a secure engagement when the plug is rotated into the retained position.

In one exemplary embodiment, the plug may have at least one projection extending at least partially radially outward from the plug body to provide a physical bayonet connection via a properly shaped at least one corresponding channel in the socket, e.g., a J-shaped channel in the socket. The channel permits the plug to be freely inserted, but when the plug is rotated relative to the socket a predetermined amount, the channel is configured to retain the at least one projection of the plug, i.e., prevent the plug from being backed out of the socket unless the plug is moved relative to the socket or the at least one projection is otherwise freed from the channel.

According to another inventive aspect of the present application, an electrical connection between a fixture arm and a wiring body may also be accomplished using a plug and socket connection. At least one electrical contact on the plug, shown schematically in FIG. 1 at 22, may be configured to engage at least one corresponding electrical contact in the socket, shown schematically at 50, when the plug 20 is coupled to the socket 34. Many different structures and configurations may be used with the plug and socket to provide an electrical connection, including, for example, electrical contacts comprising metal pins, strips, springs and/or fasteners. In one embodiment, the electrical contacts of the plug and socket may be configured such that the plug electrical contact engages the socket electrical contact when the plug is inserted into the socket and twisted or rotated from an inserted position to a retained position. In one such embodiment, a plug and socket connection may be provided with one or more of the above referenced mating portions and with a twist-to-engage electrical connection, such that rotation of the inserted plug provides secure electrical and mechanical connections, which may occur substantially simultaneously. While the illustrated embodiments show separate features or portions of the plug and socket for establishing electrical and mechanical connections, in an alternative embodiment (not shown), mating portions of the plug and socket, such as, for example, the mating portions described herein, may be provided with electrical contacts that engage with each other in the rotated or retained position. For example, a projection on the plug may be provided with a metal electrical contact that engages a corresponding metal electrical contact within a channel in the socket, thereby providing both a mechanical and an electrical connection when the projection is received in the channel.

Figure 3:
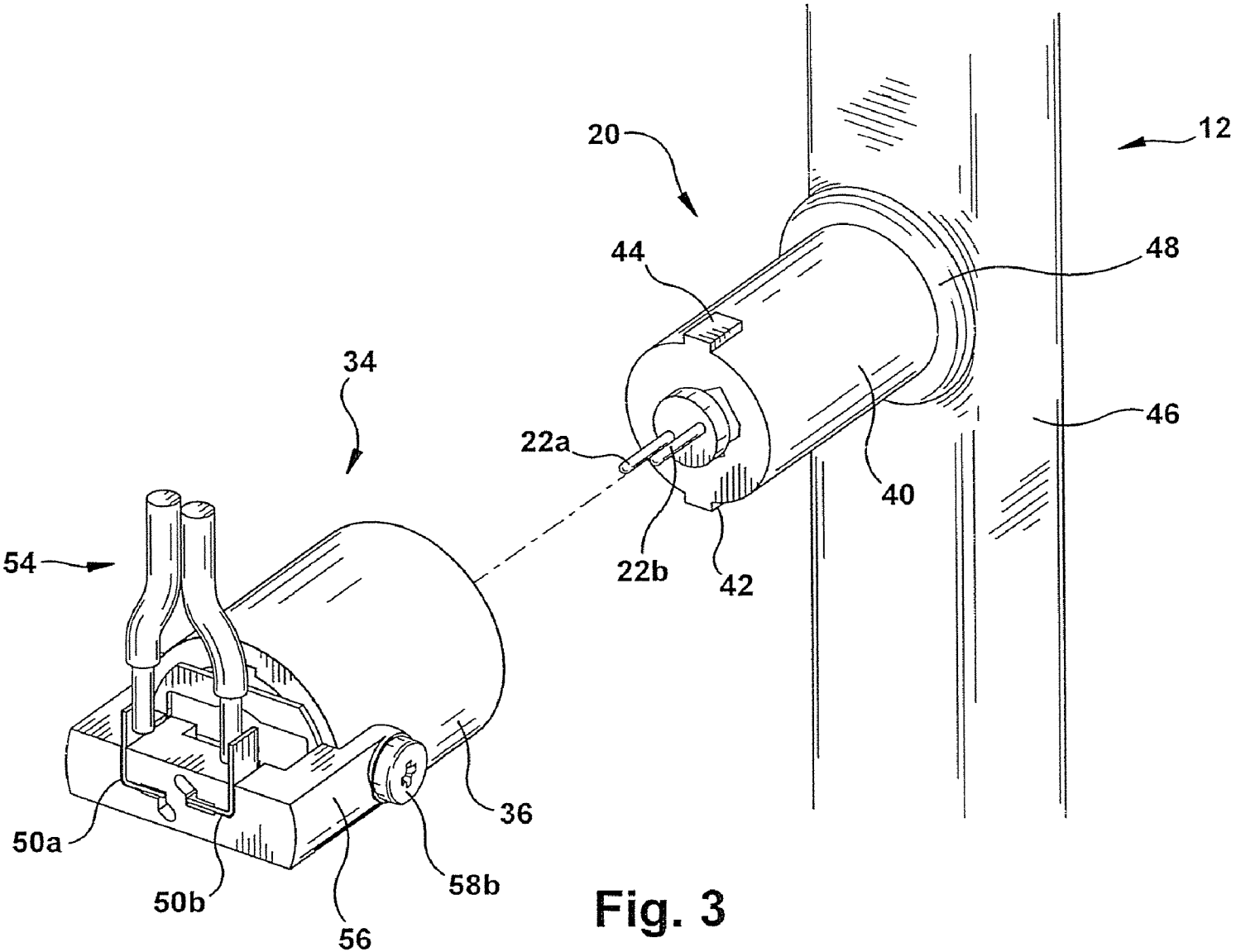
FIG. 3 is a top, left, rear isometric view of an exemplary plug and an exemplary socket.

Referring now to FIG. 3, an exemplary plug 20 and exemplary socket 34 are shown (the wiring body has been removed to show the socket). The exemplary plug 20 shown has a plug body 40 having two projections 42, 44 (two rectangular tabs are shown) and two electrical contacts 22*a*, 22*b* (two electrical pins 22*a*, 22*b* are shown). The plug body 40 is shown as being cylindrical and connected to a portion 46 of the arm 12. An optional bead 48 affixed to the arm 12 or the wiring body 14 may be used to conceal the junction between the two. The exemplary socket 34 may have at least one associated electrical contact 50 (one for each pin 22; here two electrical contacts 50*a*, 50*b* are shown) for electrical connection to electrical pins 22*a*, 22*b*. Electrical pins 22*a*, 22*b* are connected to wiring 52 (visible in FIGS. 5A-E) extending to the light socket 16 (FIG. 1) and electrical contacts 50*a*, 50*b* are connected to wiring 54 in the wiring body 14 for connection to an external source of electrical power (e.g., a breaker box via wiring or a typical wall outlet, not shown). The electrical contacts 50*a*, 50*b* are shown as being carried by a retainer 56 connected to the socket housing 36 via fasteners 58*a*, 58*b* held in openings 60*a*, 60*b* of socket housing 36 through openings 62*a*, 62*b* of retainer 56. Adjacent to the electrical contacts are connection openings 51*a*, 51*b* oriented to receive the plug electrical contacts or pins 22*a*, 22*b* when the plug 20 is inserted in the socket 34 and to allow the pins 22*a*, 22*b* to move into engagement with the socket electrical contacts 50*a*, 50*b* when the plug 20 is rotated from the inserted position to the retained position.

Figure 4:
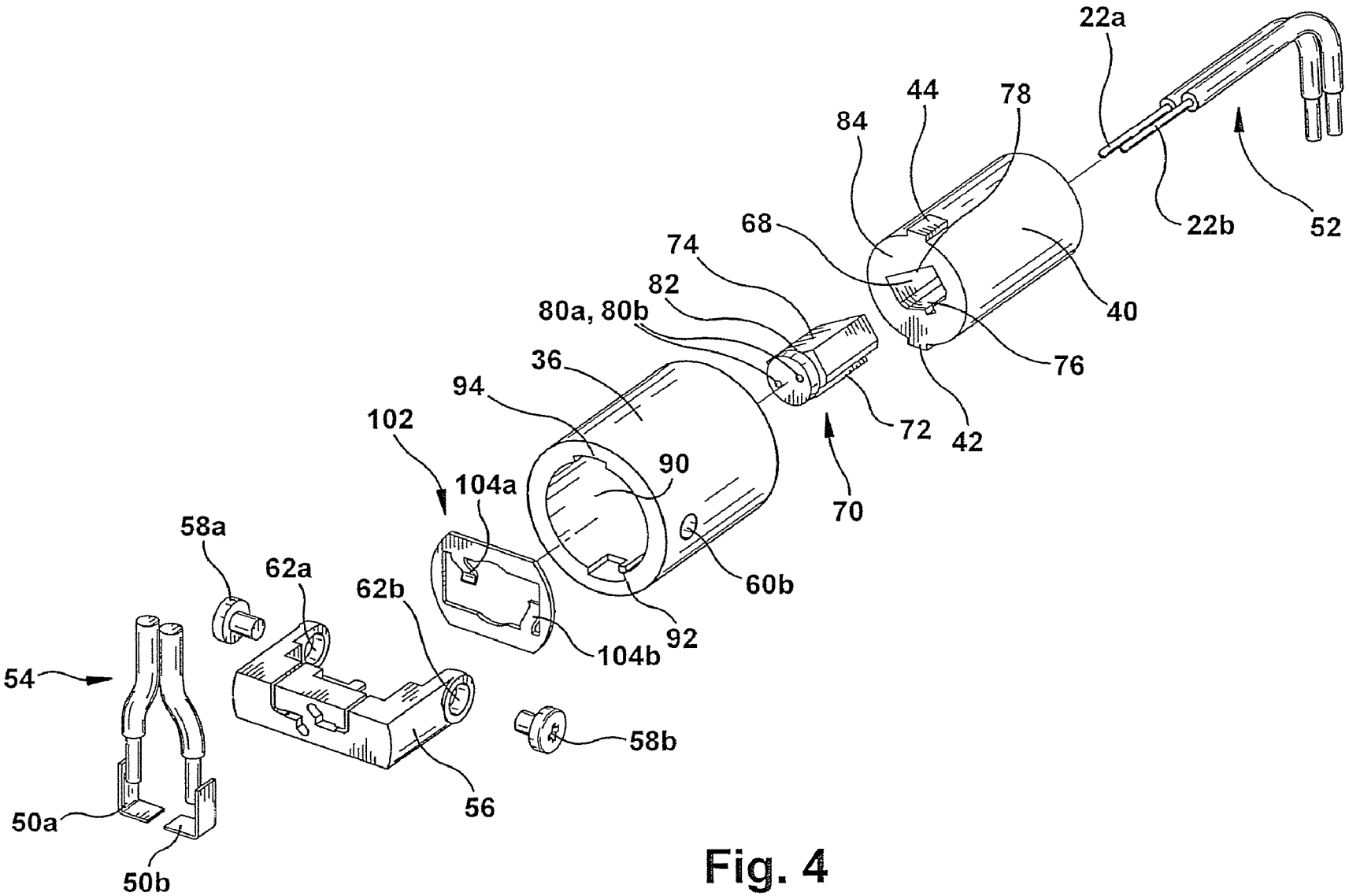
FIG. 4 is an exploded view of an exemplary plug and exemplary socket.

FIG. 4 shows additional details of the exemplary plug 20 and socket 34. Electrical contacts 22*a*, 22*b* are held in place in a cavity 68 in plug body 40 by a pin retainer 70, which is shaped to be accepted by and held by cavity 68. In the particular embodiment shown, the pin retainer 70 has a projection 72 and a planar portion 74, which correspond to a channel 76 and planar portion 78 of plug body 40. Additionally, pin retainer 70 has two openings 80*a*, 80*b* which accept and retain pins 22*a*, 22*b*, respectively. Pin retainer 70 also has a stop 82 that engages a surface 84 of plug body 40. socket housing 36 has a cylindrical opening 90 sized to just fit cylindrical plug body 40 and having two associated channels 92, 94 corresponding to the two projections 42, 44 of plug body 40. The pin retainer may be constructed of any suitable material, such as, for example, such as a blended nylon or a polycarbonate/ABS blend. In one exemplary embodiment, the pin retainer material complies with UL, requirements, such as, for example, a minimum HB flame class rating, a minimum RTI (relative thermal index) value of 50° C., a minimum CTI (comparative tracking index) rating of 3V (for Canadian coverage).

Figure 4A:
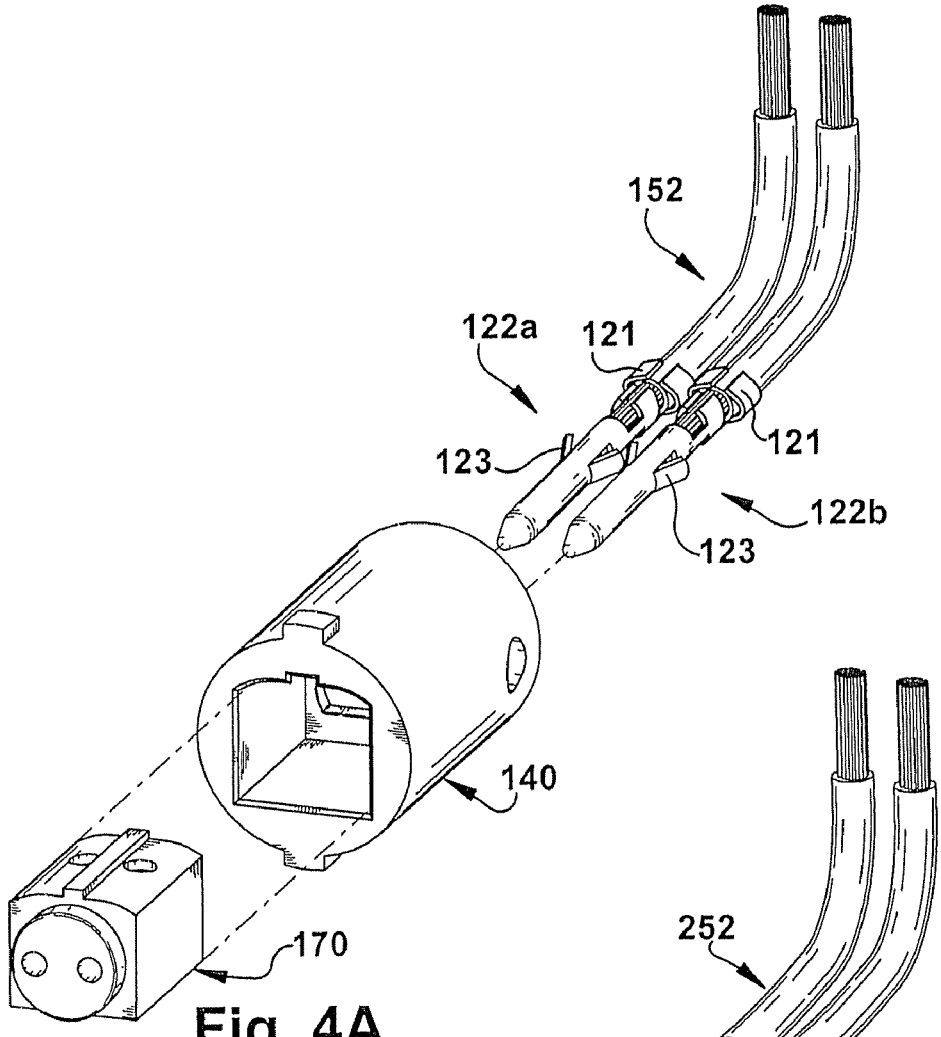
FIG. 4A is an exploded view of an exemplary plug.

Many different configurations may be used to secure the pins 22*a*, 22*b* to the wiring 52 and within the pin retainer 70. Examples of such configurations include, for example, press fit engagement, soldering, adhesives, fasteners, and other such connections. In one exemplary embodiment, as shown in FIG. 4A, the pins 122*a*, 122*b* may be crimped onto the ends of wires 152 at crimped portions 121, using, for example, an AMP type crimped pin configuration. The pins may, but need not, include barbed portions 123, which allow the pins 122*a*, 122*b* to be pressed through the pin retainer 170, while preventing the pins from being withdrawn from the pin retainer 170. These pins 122*a*, 122*b* may be manufactured by many different methods, such as, for example, stamping, and may be made of stamped metal (e.g., pre-tinned brass) or another suitable electrical conductor.

Figure 4B:
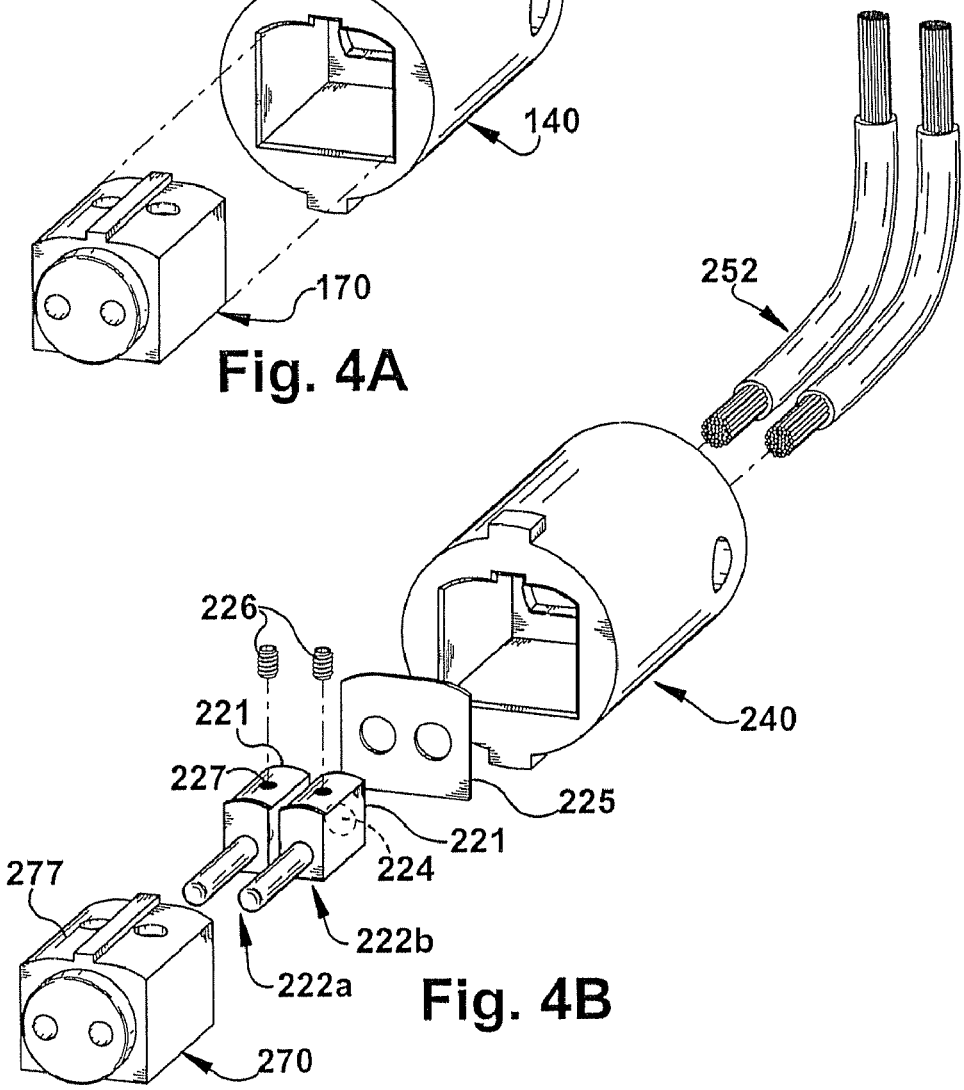
FIG. 4B is an exploded view of another exemplary plug.
Figure 5A:
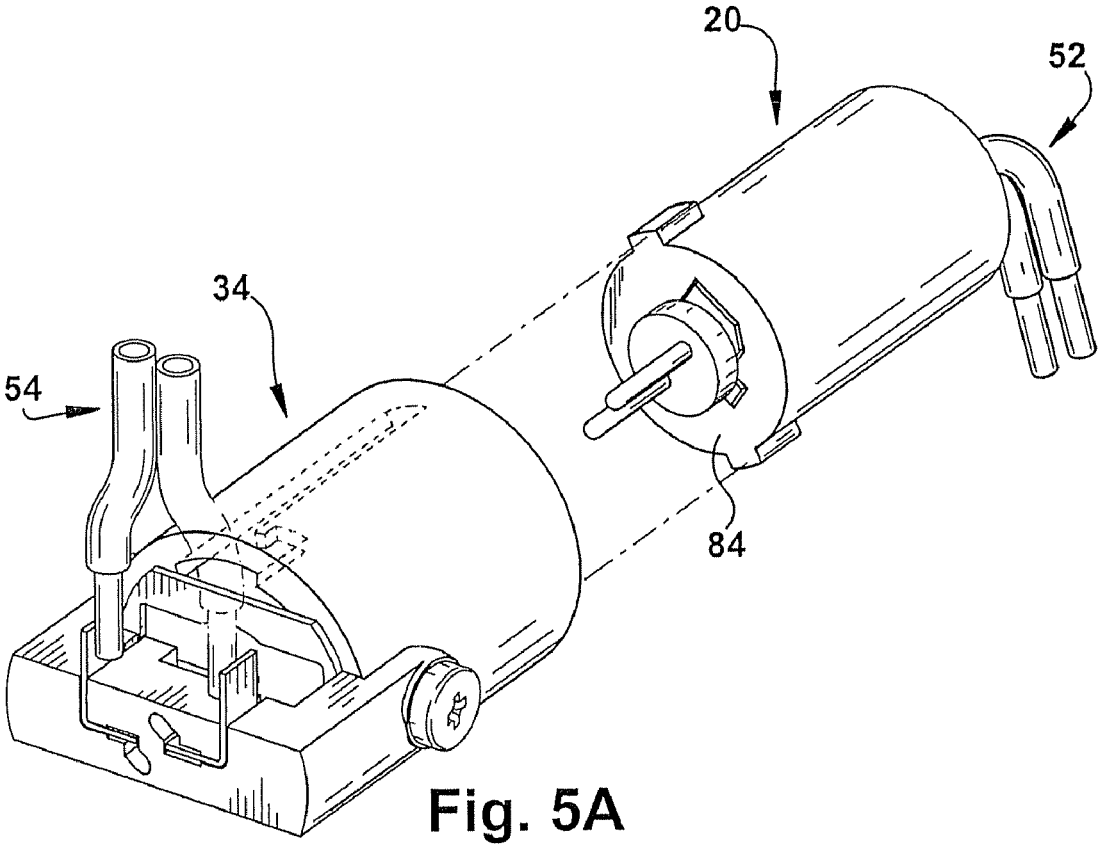
FIG. 5A-5E are a series of figures showing the exemplary plug being coupled to the exemplary socket.
Figure 5B:
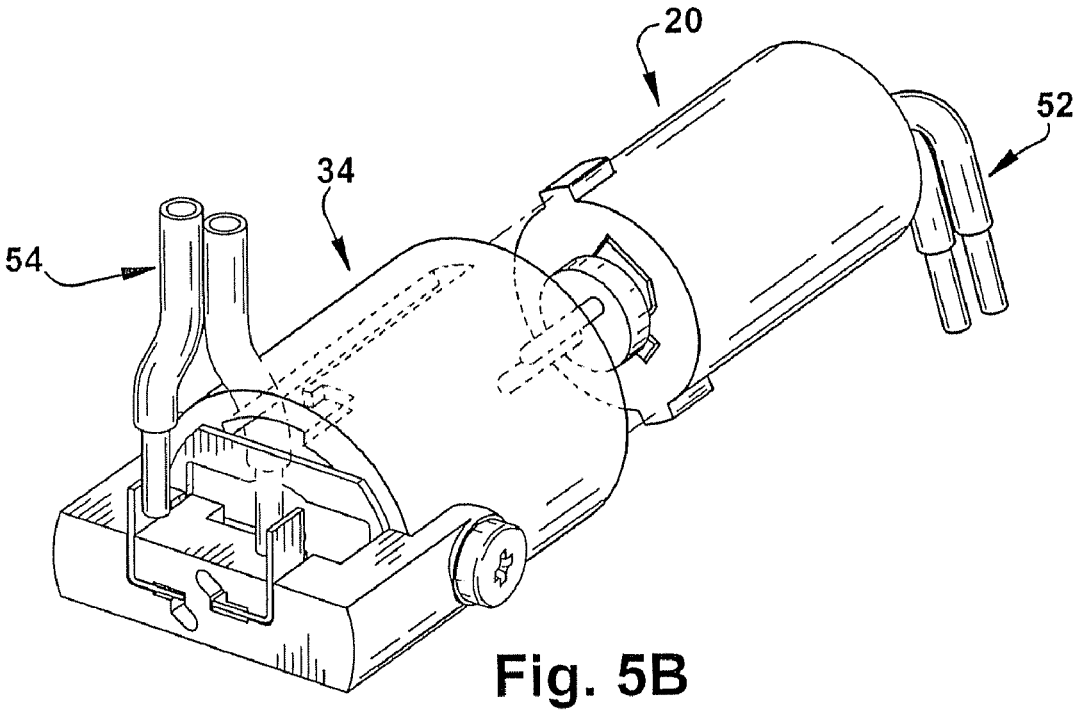
Figure 5C:
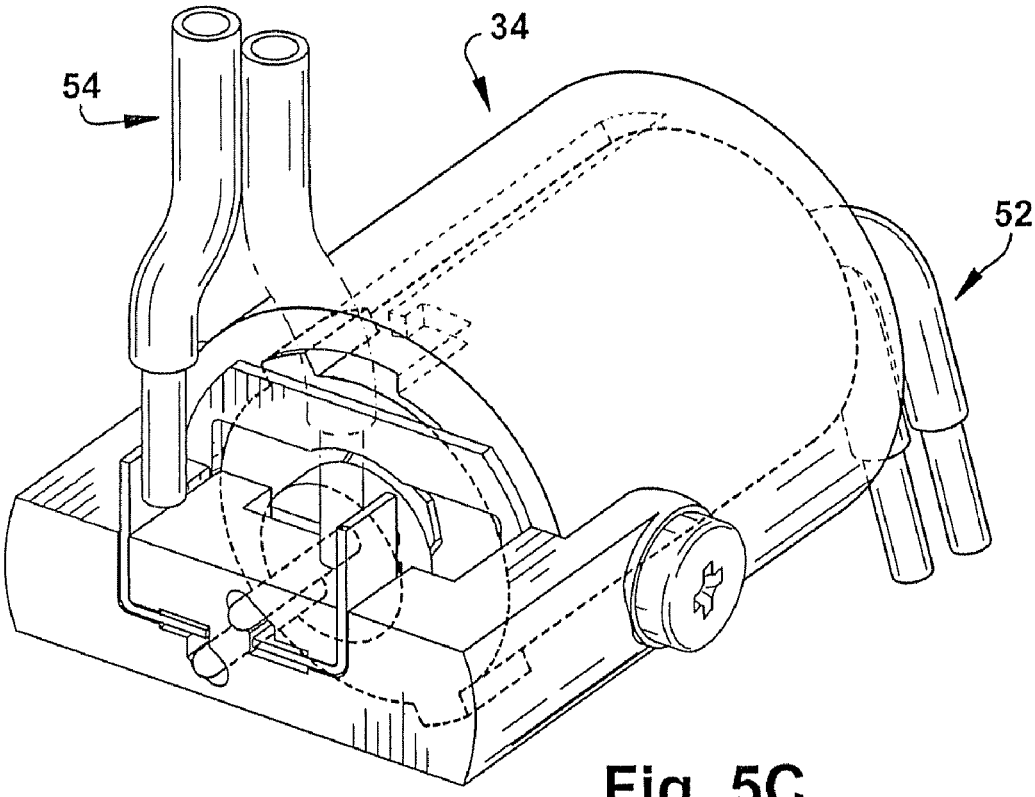
Figure 5D:
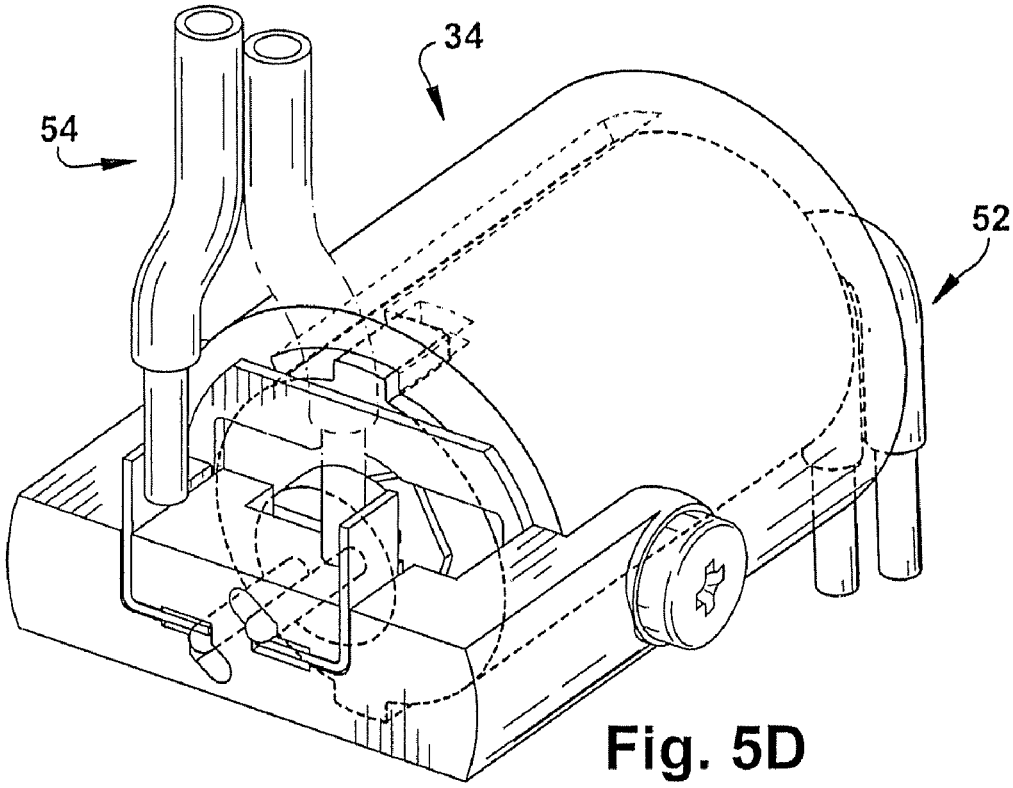
Figure 5E:
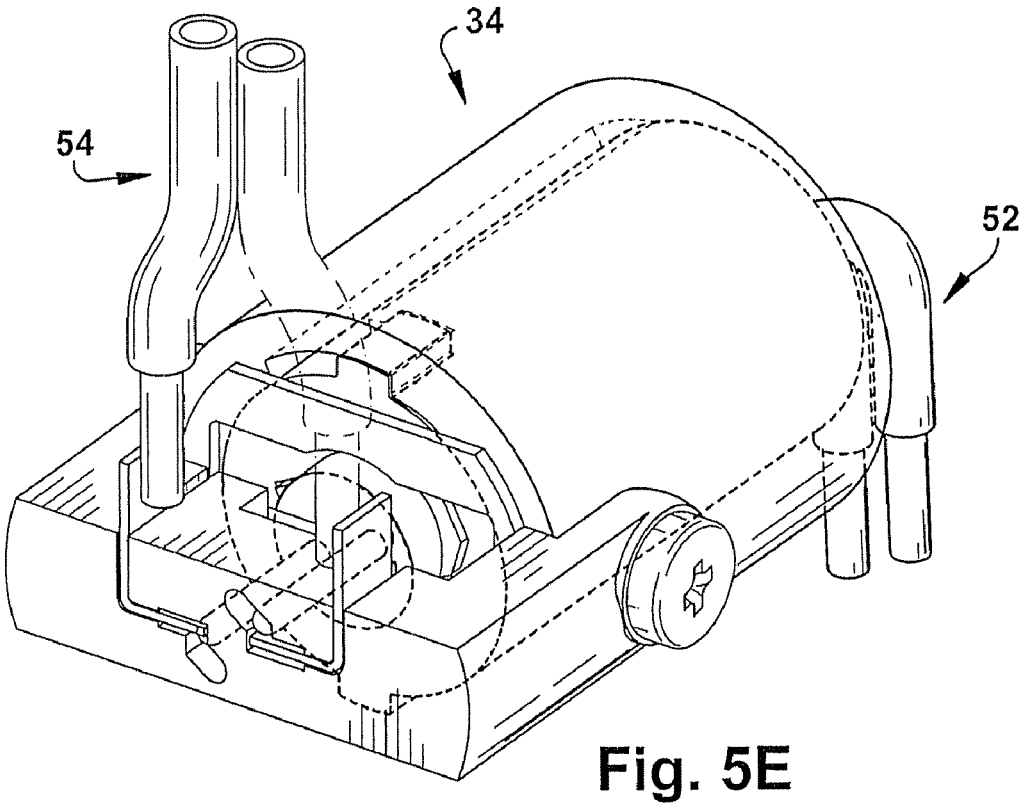

In another exemplary embodiment, as shown in FIG. 4B, pin members 222*a*, 222*b* may include pins 223 and block portions 221 with holes 224 for receiving ends of the wiring 252. Pins 223 and block portions 221 may be integrally formed or formed from separate parts that are connected, e.g., soldered. An insulating gasket 225 may optionally be provided behind the block portions 221 to prevent contact between the pin members 222*a*, 222*b* and the plug body 240, which may be provided as a metal component, such as aluminum. The gasket 225 may be any suitable insulating material, such as, for example, nylon. To secure the pin members 222*a*, 222*b* within the pin retainer 270 and the wiring 252 to the pin members, the exemplary pin retainer and pin members 222*a*, 222*b* may be provided with aligned threaded holes 277, 227 to receive corresponding set screws 226, which may be tightened to provide secure engagement between the pin retainer 270, the pin members 222*a*, 222*b*, and the wiring 252. The set screw connections between the block portions 221 and the wiring 252 may provide a more durable connection between the pins 222*a*, 222*b* and the wiring 252, to withstand repeated twisting from coupling and uncoupling the plug and socket connection. The pin members 222*a*, 222*b* may be manufactured by many different methods, such as, for example, casting, and may be constructed of any suitable material, such as, for example, tinned or nickel-plated brass or copper.

Many different types of channels may be provided with the socket and/or the plug to provide a bayonet type connection. The channel may, for example, be recessed in the inner surface of the socket opening or in the outer surface of the plug body, or the channel may be defined by ridges or other such structure extending from the socket or plug surfaces. Also, while the channel may be defined by two sides or edges along the entire length of the channel, the channel may alternatively be defined by only one side or edge along at least a portion of the channel. The channel or channels may take many different shapes or configurations. In one exemplary embodiment, the channel may be oriented such that when the plug is inserted and rotated in the socket, a projection received in the channel moves into a locking portion of the channel, in which the projection is securely retained. One such exemplary channel may be described as a J-channel, as it includes a longer generally axial portion into which a projection is first received, a generally lateral or circumferential portion through which the projection travels when the plug is rotated, and a shorter generally axial portion (which may be a locking portion) into which the projection may be received upon rotation of the plug (thus forming a "J" shape).

Figure 7:
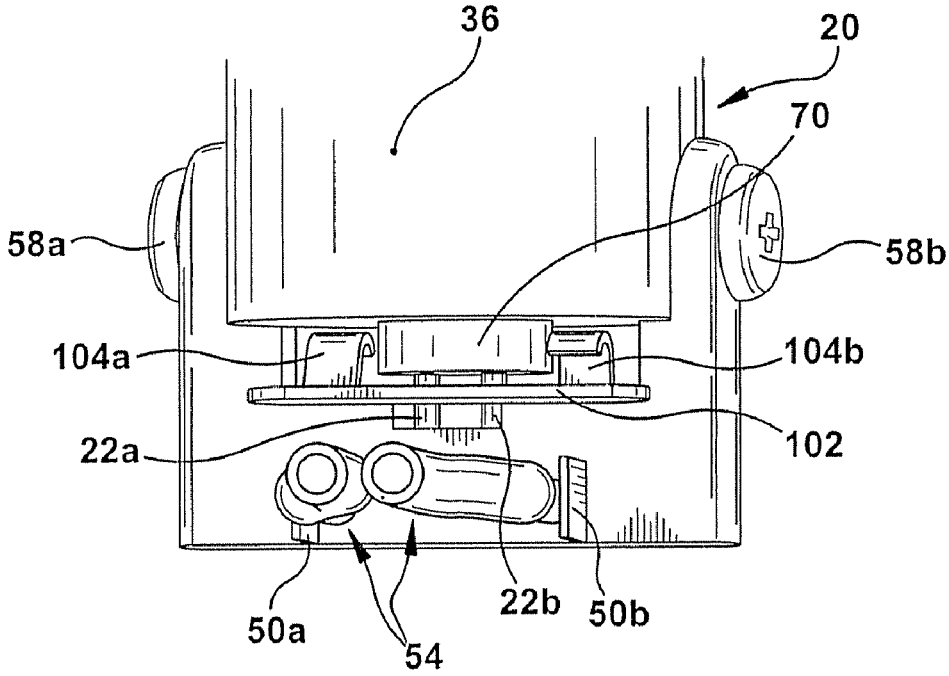
FIG. 7 is a top plan view (slightly off the vertical axis) of a rear portion of an exemplary plug and an socket housing.

Retention of the projection in the locking portion may be accomplished by many different configurations, such as, for example, a snap fit engagement between the projection and the locking channel. In one embodiment, a resilient member disposed between the socket body and the inserted plug may be compressed when the plug is pressed against the socket and rotated, exerting a biasing force to bias the plug with respect to the socket so as to hold the projection in the locking portion of the channel. In an exemplary embodiment, as shown in FIG. 7, the socket has a resilient member that is a spring plate 102 disposed at the inner end of the socket opening and having a first spring 104*a* and a second spring 104*b* (bent legs of spring plate 102), which engage surface 84 of plug body 40. The other side of the spring plate 102 engages the retainer 56.

Figure 6:
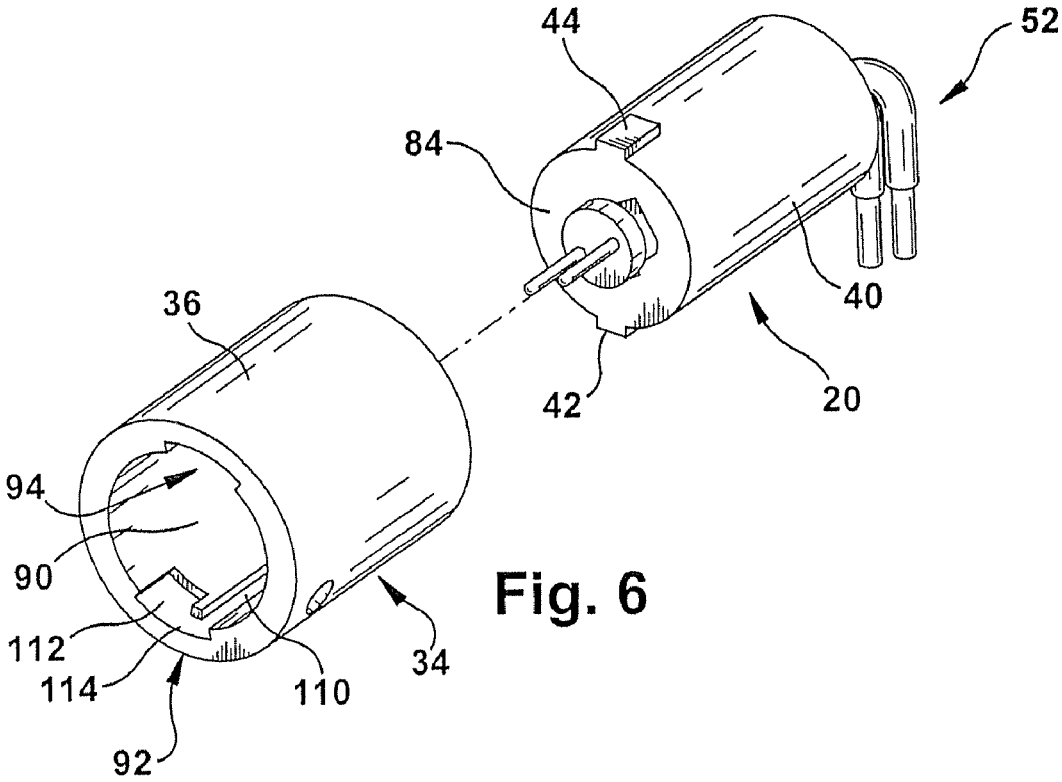
FIG. 6 is a top, left, rear isometric view of an exemplary plug and an exemplary socket housing.
Figure 8A:
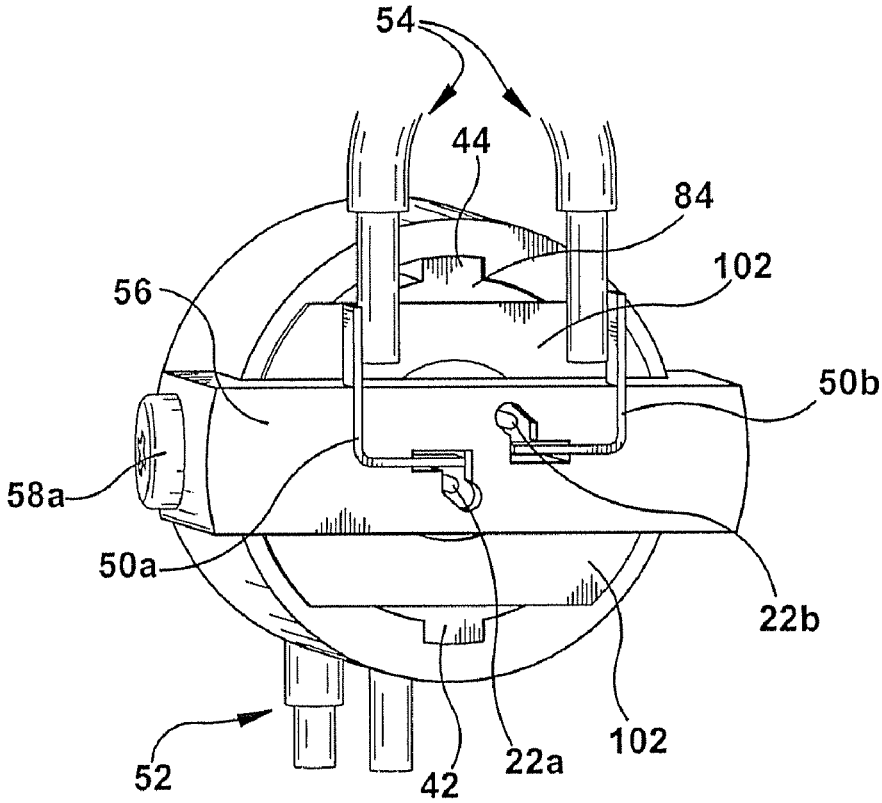
FIG. 8A is a top-right-rear isometric view of an exemplary socket and plug.
Figure 8B:
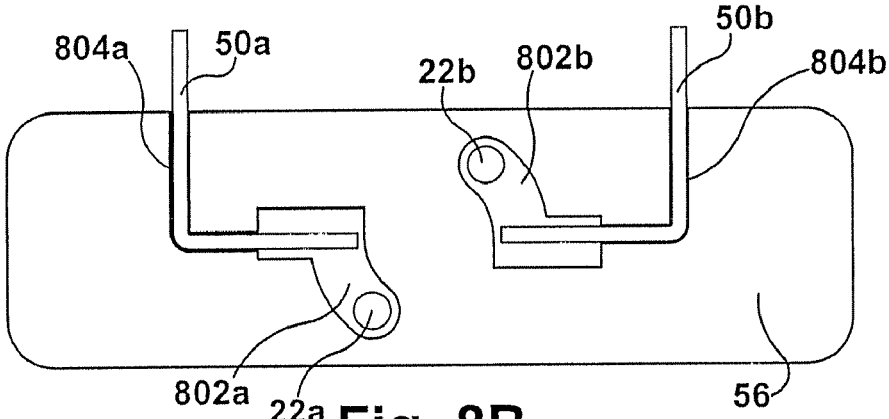
FIGS. 8B-8E are rear end views of a portion of the exemplary socket and plug of FIG. 8.
Figure 8C:
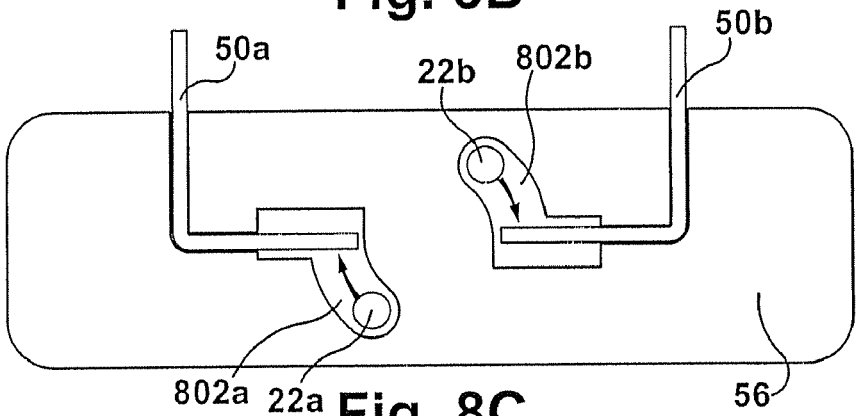
Figure 8D:
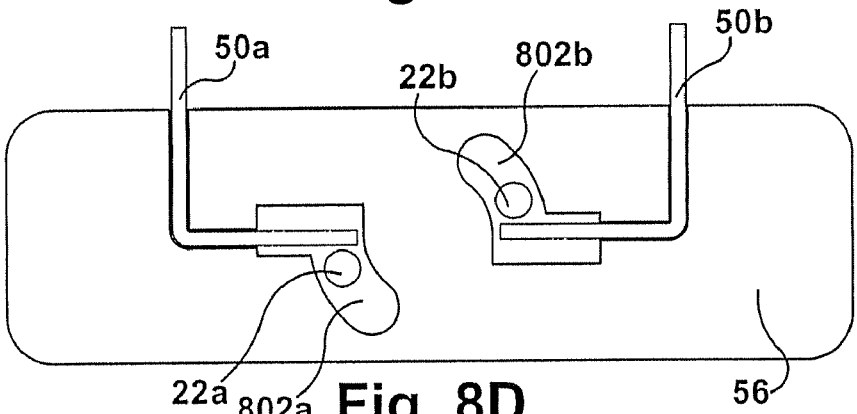
Figure 8E:
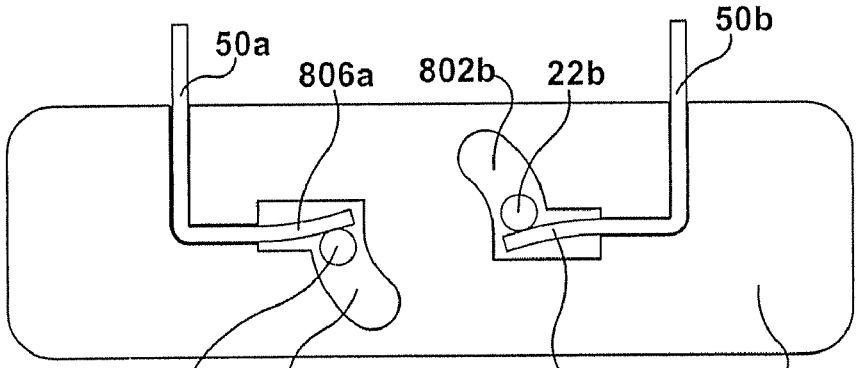
Figure 13:
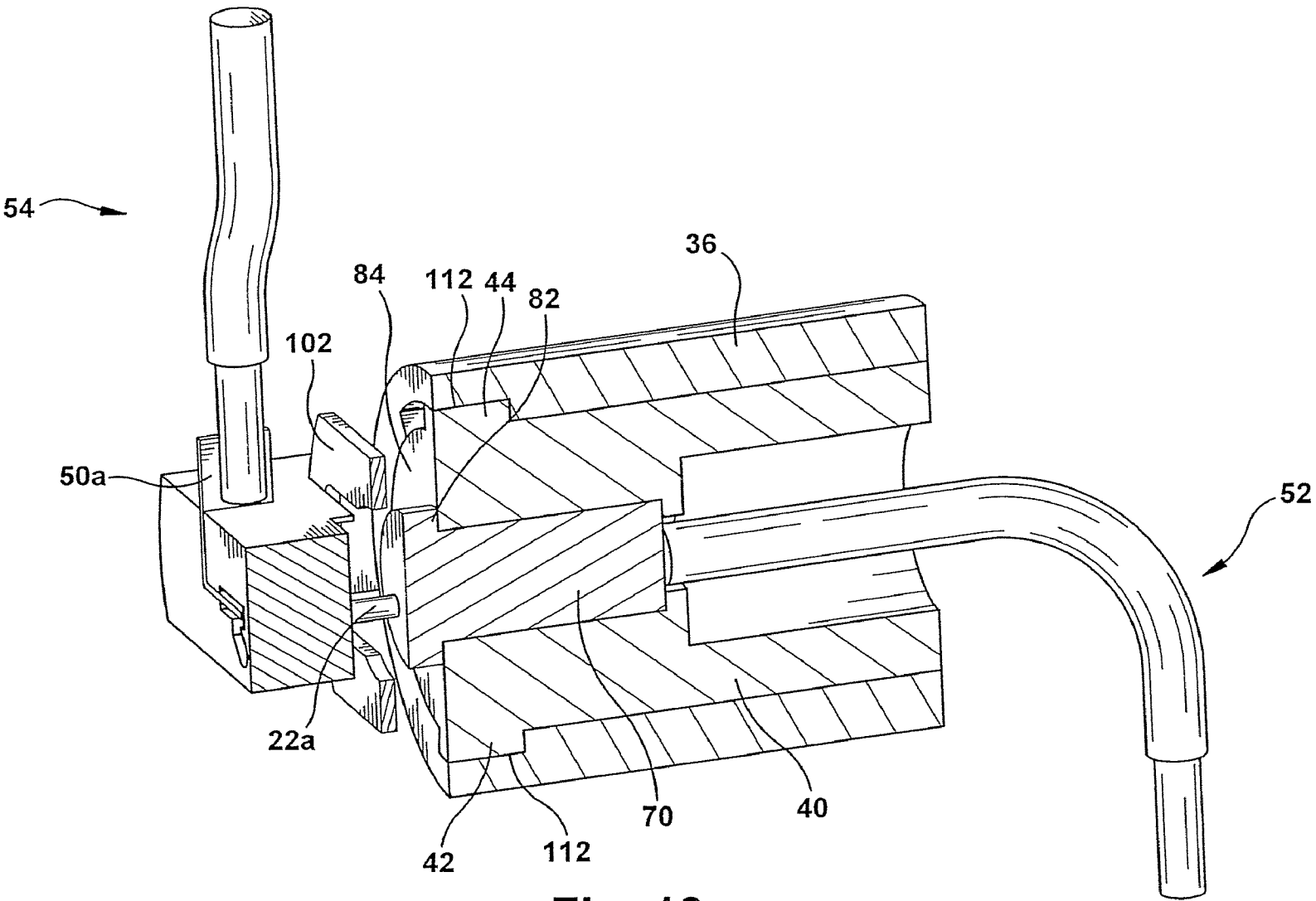
FIG. 13 is a sectional view of an exemplary plug within an exemplary socket, the section being taken vertically along a central axis.
Figures 14A, 14B:
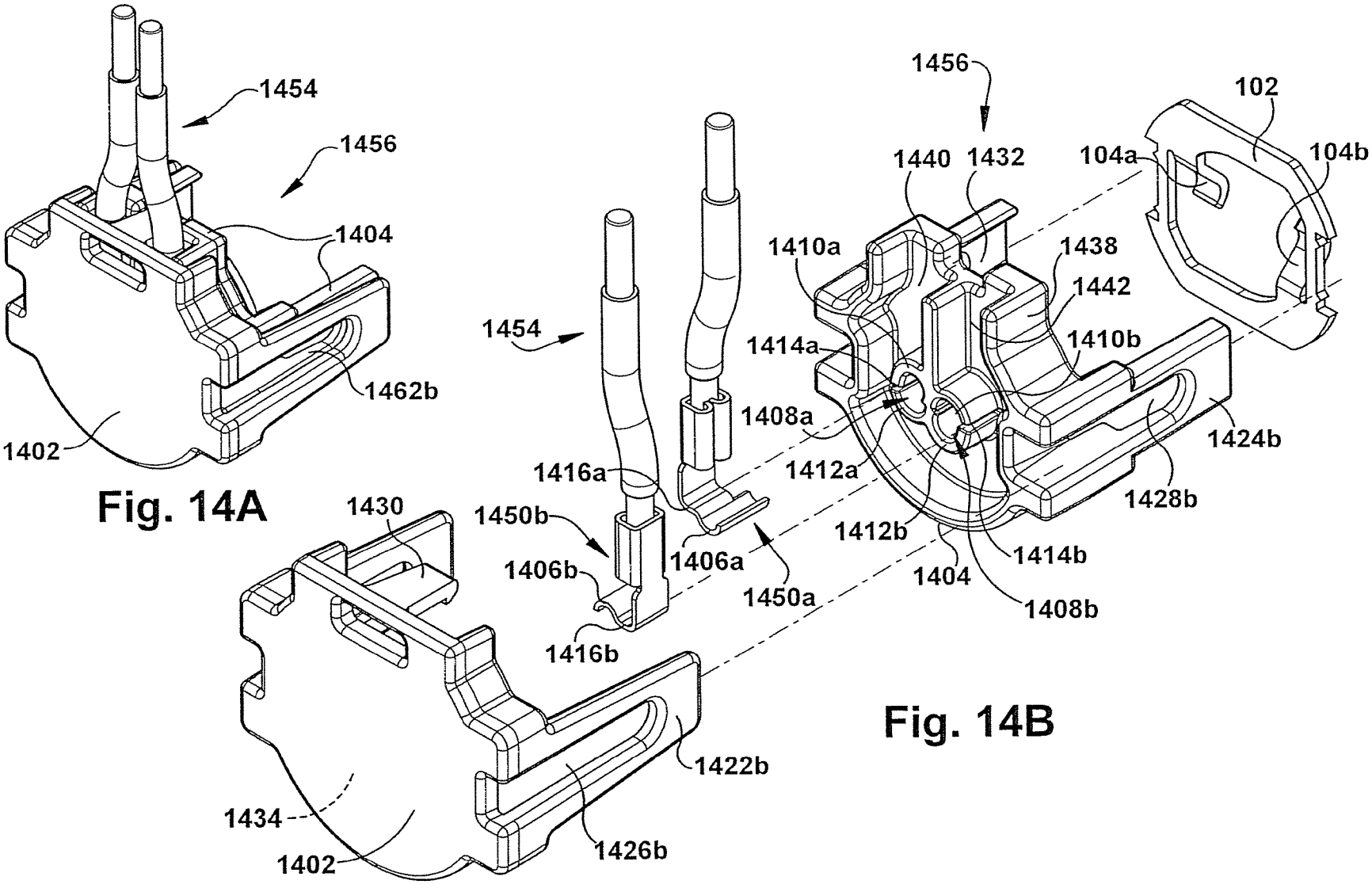
FIGS. 14A-14B are top, left, rear isometric views

Referring now to FIG. 6, the exemplary J-channels 92, 94 each have a longer generally axial receiving portion 110 and a shorter generally axial locking portion 112, connected by a generally circumferential connecting portion 114. The receiving portions 110 of the exemplary J-channels 92, 94 extend to the outer end of the socket opening, while the locking portions 112 do not. Prior to the plug 20 being inserted into the socket 34, the plug 20 and socket 34 are positioned coaxially (their cylindrical axes being coaxial) and the projections 42, 44 of plug body 40 are aligned with the longer axial portion 110 of the J-channels 92, 94 (FIGS. 8A-8B; contacts 50*a*, 50*b* are gripped and held in place by narrow channels 804*a*, 804*b*), which causes the pins 22*a*, 22*b* to be aligned with openings 802*a*, 802*b* (FIGS. 8B-8E). While the receiving portions 110 of the channels 92, 94 are shown as having uniform width, they may alternatively be tapered outward at the outer end of the socket 34 (not shown) to more easily guide the projections into position. As the plug 20 is inserted into the socket 34, the projections 42, 44 of plug body 40 slide in the receiving portions 110 of the J-channels 92, 94, and the pins 22*a*, 22*b* enter openings 802*a*, 802*b* proximate contacts 50*a*, 50*b* (FIGS. 8B-8E). Eventually, while the projections 42, 44 of the plug body 40 slide in the receiving portions 110 of the J-channels 92, 94, the end portion 84 of the plug body 40 contacts the springs 104*a*, 104*b* of spring plate 102. Additional pressure on the plug 20 in the same direction will permit the projections 42, 44 of plug body 40 to align with the connecting portion 114 of the J-channels 92, 94 (FIG. 5C), permitting the plug 20 to be turned as the projections 42, 44 slide in the connecting portion 114 of the J-channels 92, 94 toward the locking portions 112 of the J-channels 92, 94, and the pins 22*a*, 22*b* rotate in openings 802*a*, 802*b* toward contacts 50*a*, 50*b* (FIG. 8C). The plug 20 and socket 34 may be configured so that the plug may be turned from about 5° to about 10° (or from 5° to 10°) with respect to the socket to seat or retain the plug in the socket in a retained position. Eventually, the projections 42, 44 of plug body 40 align with the locking portions 112 of the J-channels 92, 94 (FIG. 5D), and the pins 22*a*, 22*b* make electrical contact or engagement with contacts 50*a*, 50*b* (FIGS. 8D and 8E). As shown in FIG. 8E, a portion 806*a*, 806*b* of the contacts may be configured to flex to establish a better electrical connection with the pins 22*a*, 22*b*. Additionally or alternatively, the portions 806*a*, 806*b* of the electrical contacts 50*a*, 50*b* that contact the pins 22*a*, 22*b* may be shaped to provide more than one contact point with the pins 22*a*, 22*b* (e.g., shaped with a curved portion, as shown in the embodiment of FIGS. 14A-B, or shaped with a "V" shaped portion (not shown)). In the retained position, if the plug 20 is released (or no longer pushed against the socket), the springs 104*a*, 104*b* of spring plate 102 will flex back and retain the projections 42, 44 of plug body 40 within the locking portions 112 of the J-channels 92, 94 (FIGS. 5E, 7, and 13), and the pins 22*a*, 22*b* will slide along contacts 50*a*, 50*b*, maintaining electrical contact therewith (FIGS. 8D and 8E). The exemplary plug 20 may be removed by pushing the plug 20 against the springs 104*a*, 104*b* until the projections 42, 44 of plug body 40 align with the connecting portions 114 of the J-channels 92, 94, permitting the plug 20 to be turned as the projections 42, 44 slide in the connecting portion 114 of the J-channels 92, 94 toward the receiving portions 110 of the J-channels 92, 94. Once the projections 42, 44 of plug body 40 align with the receiving portions 112 of the J-channels 92, 94, the plug 20 may be removed from the socket 34 of wiring body 14.

Figure 9:
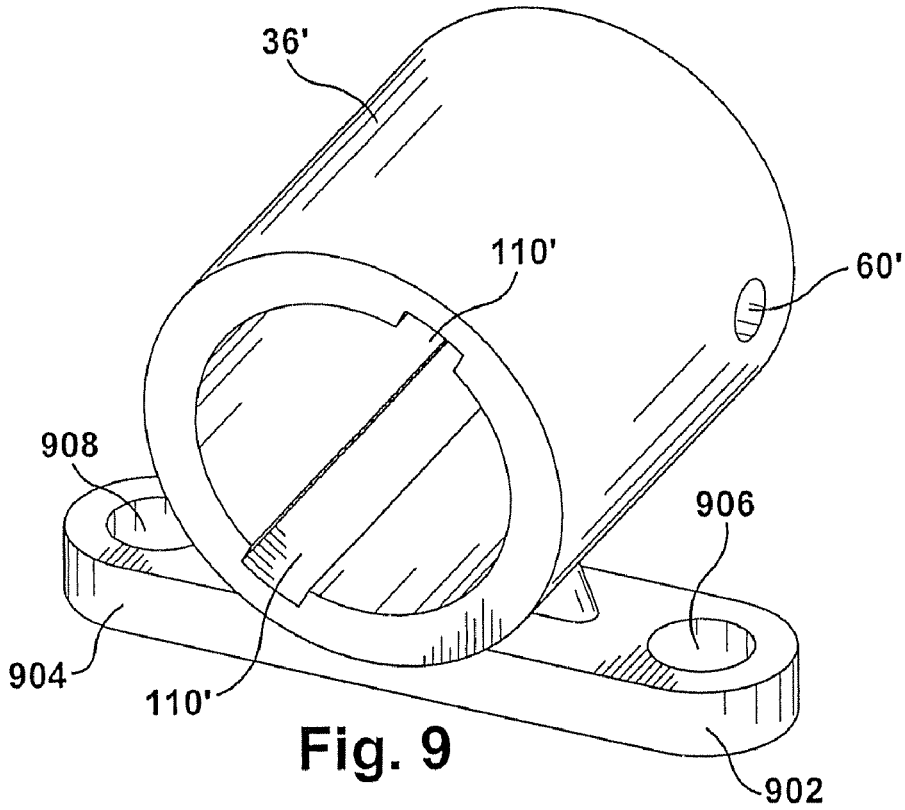
FIG. 9 is a top-right-front view of an exemplary socket housing with exemplary side-mount tabs.
Figure 10:
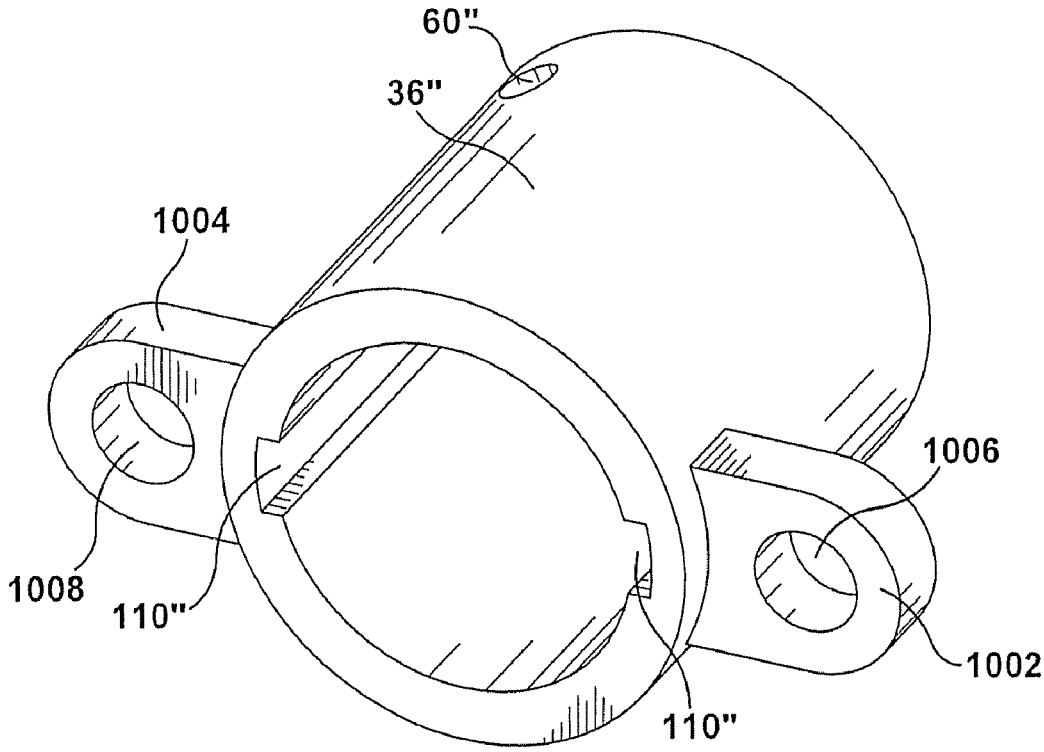
FIG. 10 is a top-right-front view of an exemplary socket housing with exemplary top-mount or bottom-mount tabs.
Figure 11A:
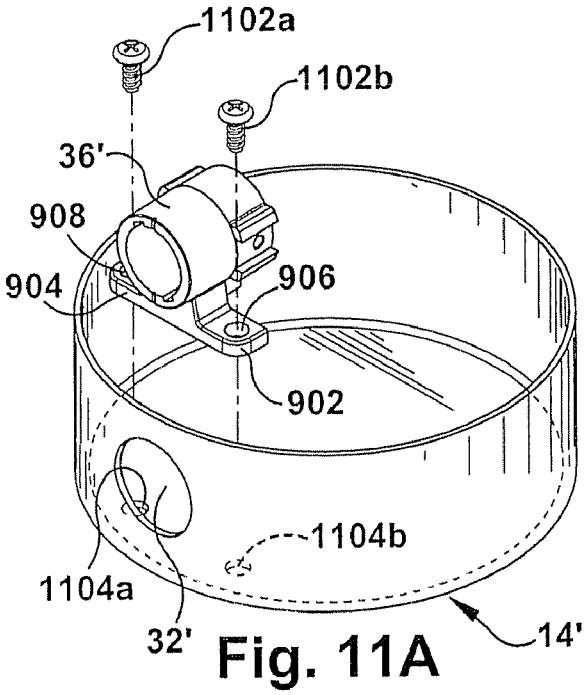
FIGS. 11A-11B show an exemplary side installation.
Figure 11B:
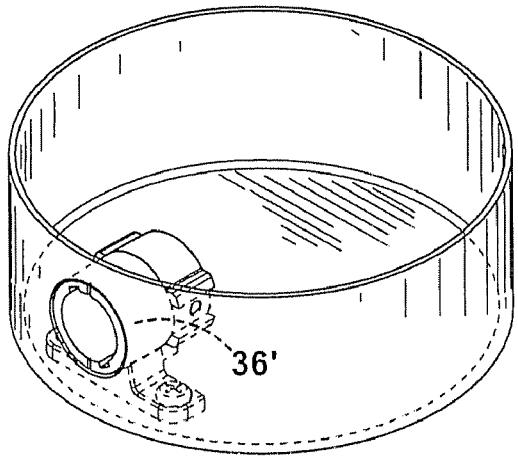
Figure 12A:
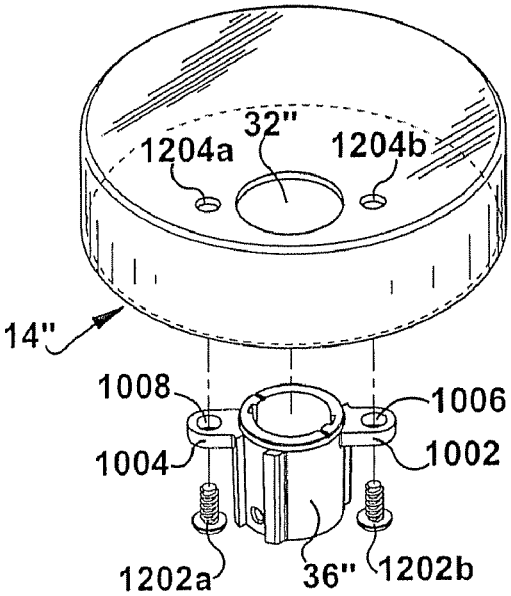
FIGS. 12A-12B show exemplary top installations.
Figure 12B:
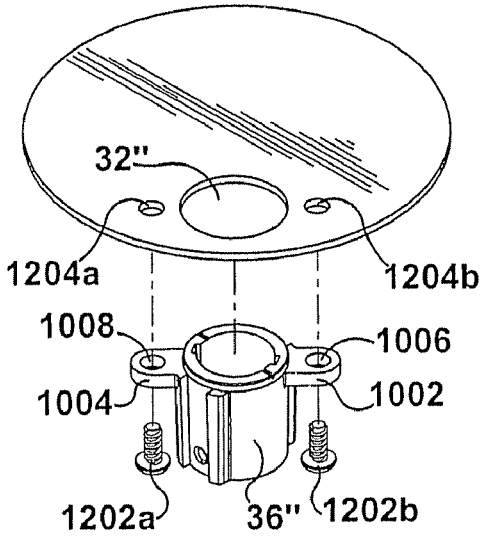

The exemplary sockets 34 may be configured to be mounted to a side wall (e.g., an inside top wall, inside side wall, or inside bottom wall) of a wiring body 14. FIGS. 9 and 10 show two different mounting configurations for exemplary socket housings 36' and 36". FIG. 9 shows an exemplary socket housing 36' having mounting tabs 902, 904 having openings 906, 908 for side mounting to a wiring body and FIG. 10 shows exemplary socket housing 36" having mounting tabs 1002, 1004 having openings 1006, 1008 for top/bottom mounting to a wiring body. FIGS. 11A-11B show an exemplary side mount socket housing 36' in an exemplary side installation in a wiring body 14' via fasteners 1102*a*, 1102*b* in threaded openings 1104*a*, 1104*b* through openings 906, 908. FIG. 12A-12B show exemplary top mount socket housings 36" in exemplary side installations in a wiring body 14" and to a plate 1200 via fasteners 1202*a*, 1202*b* in threaded openings 1204*a*, 1204*b* through openings 1006, 1008.

The pins 22 may be made from any suitable material that is an electrical conductor, such as, for example, brass or copper. The contacts 50 may also be made from any suitable material that is an electrical conductor, such as, for example, spring steel or phosphor bronze. The portion(s) of pin retainer 70 and retainer 56 that contact the pins 22 and the contacts 50, respectively, may be made of a material that is an electrical insulator, such as molded nylon or molded polypropylene. The socket housing 36 and plug body 40 (with its two projections 42, 44) provide mechanical support for the arm 12. Accordingly, socket housing 36 and plug body 40 are preferably constructed to provide a strong enough connection to support the load of the arm 12, and may be made, for example, from cast or machined zinc or aluminum. The plug body 40 may be welded to the arm portion 46. The wiring 52, 54 may be any of many types of insulated conductors.

The fixture 10 may be shipped with the one or more arms 12 disconnected from the wiring body 14 to permit smaller packaging. At any time, the one or more arms 12 may be attached (aligned, inserted, twisted while pushing, and released, as discussed above) to the wiring body either before or after the fixture is attached to a wall, ceiling, post, etc. The present application contemplates a fixture for which fixture arms may be readily detached from the wiring body as desired, by pushing and twisting the plug with respect to the socket to return the plug to its inserted position from which the plug may be withdrawn. Thus, any of the connector embodiments herein may be configured to permit fixture (or portable) arms to be removably attached to a corresponding wiring body. However, in other embodiments (not shown), the fixture may be further adapted to provide a more permanent connection between the wiring body and fixture arms, through the use of, for example, additional fasteners, spring-loaded members, adhesives, or plug and socket mating features that more permanently lock into engagement with each other upon connection of the fixture arm to the wiring body.

FIGS. 14A-14B illustrate another exemplary two-piece electrical contact retainer 1456. Exemplary two-piece electrical contact retainer 1456 comprises first and second retaining components 1402, 1404, which cooperate to retain electrical contacts 1450*a*, 1450*b* in place for electrical connection to pins of a corresponding plug. In this embodiment, electrical contacts 1450*a*, 1450*b* each have first and second perpendicular legs, a curved portion 1406*a*, 1406*b*, respectively, which extends from the first leg and accepts a corresponding pin of a connected plug. As shown, electrical connection portions of the second legs of the electrical contacts 1450*a*, 1450*b* can be crimped to respective wires of corresponding wiring 1454. The second retaining component 1404 of retainer 1456 has two openings 1408*a*, 1408*b*, one for each of the electrical contacts 1450*a*, 1450*b*. Openings 1408*a*, 1408*b* each have a curved portion 1410*a*, 1410*b* that accepts a respective curved portion 1406*a*, 1406*b* of a corresponding electrical contact 1450*a*, 1450*b*. Openings 1408*a*, 1408*b* also each have another portion 1412*a*, 1412*b* that accepts a respective pin of an inserted plug. Openings 1408*a*, 1408*b* also each have a corresponding slot 1414*a*, 1414*b* that accepts a respective portion 1416*a*, 1416*b* of a corresponding electrical contact 1450*a*, 1450*b*.

Many different configurations may be used to attach the contact retainer to the socket housing, such as, for example, fasteners, adhesives, and threaded connections. In one embodiment, one or more mounting flanges may be provided on one or both of the contact retainers and the socket housing to facilitate attachment. In the exemplary embodiment, first retaining component 1402 of two-piece electrical contact retainer 1456 has a pair of projections or mounting flanges 1422*a*, 1422*b* on either side thereof. Similarly, second retaining component 1404 of two-piece electrical contact retainer 1456 has a corresponding pair of projections or mounting flanges 1424*a*, 1424*b* on either side thereof. Each projection 1422 has a corresponding opening 1426 and each projection 1424 has a corresponding opening 1428. When first and second retaining components 1402, 1404 are coupled together, projections 1422 align with projections 1424 and openings 1426 align with openings 1428 to form openings 1462*a*, 1462*b* that accept fasteners (1558 in FIG. 15, 1658 in FIG. 16) to secure the two-piece electrical contact retainer 1456 to a socket housing. First retaining component 1402 of exemplary two-piece electrical contact retainer 1456 has a projection 1430 accepted by a slot 1432 of second retaining component 1404. Similarly, first retaining component 1402 of exemplary two-piece electrical contact retainer 1456 has an inner peripheral opening 1434 that accepts an outer periphery 1438 of second retaining component 1404. Second retaining component 1404 of exemplary two-piece electrical contact retainer 1456 has openings 1440, 1442 for accepting wires of wiring 1454 that form corresponding wiring cavities when mated with first retaining component 1402.

Figure 15:
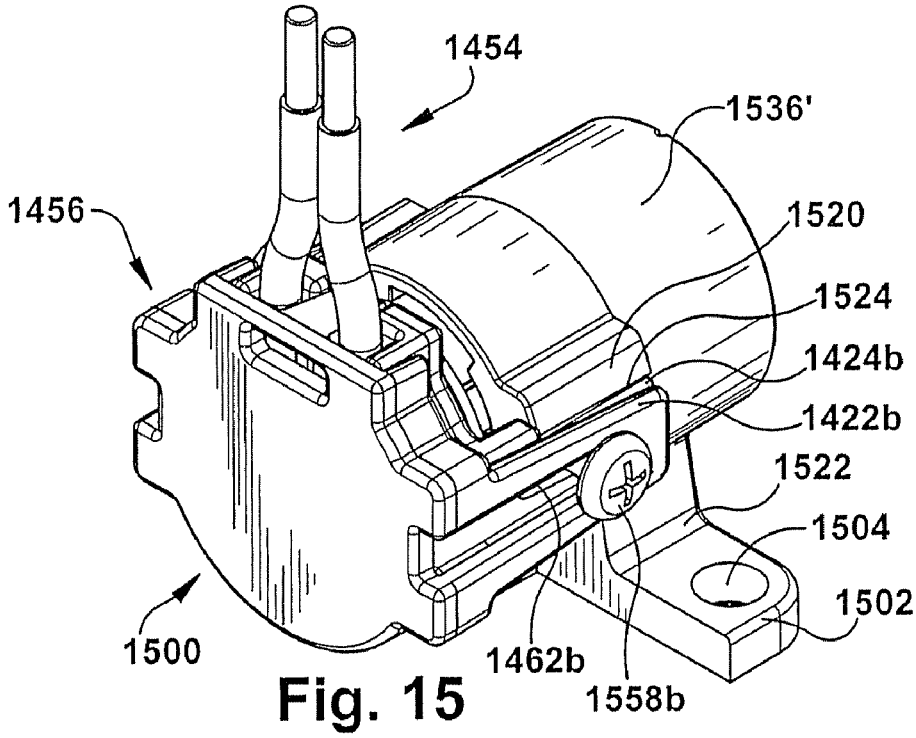
FIG. 15 is a top, left, rear isometric view of an exemplary side-mount socket with an exemplary two-piece electrical contact retainer of FIGS. 14A-14B.
Figure 16:
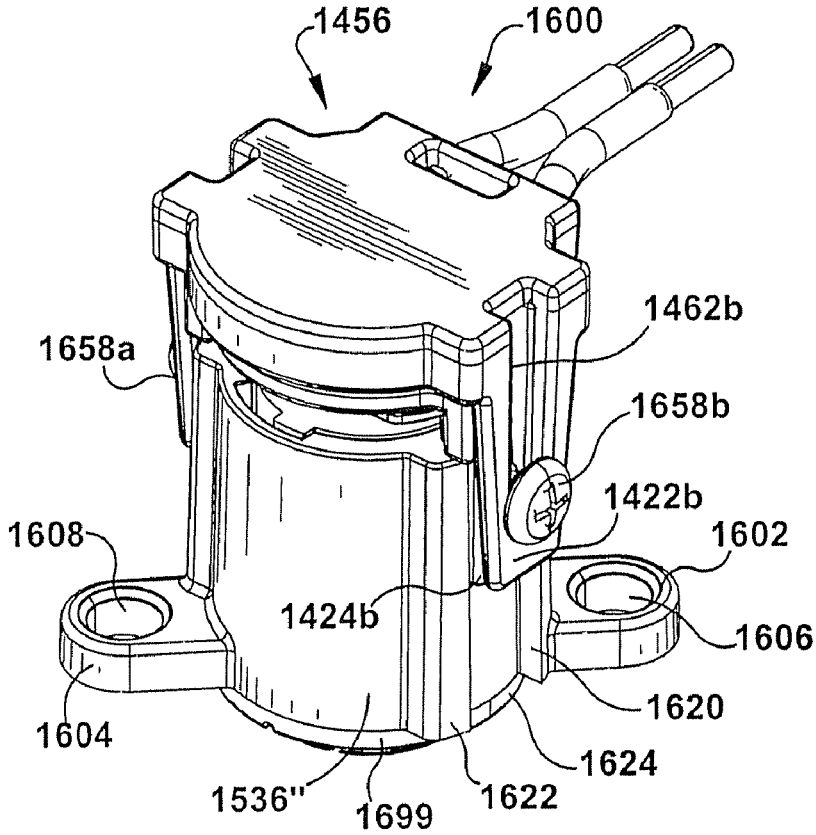
FIG. 16 is an isometric view of an exemplary top-mount socket or bottom-mount socket with an exemplary two-piece electrical contact retainer of FIGS. 14A-14B.
Figure 17:
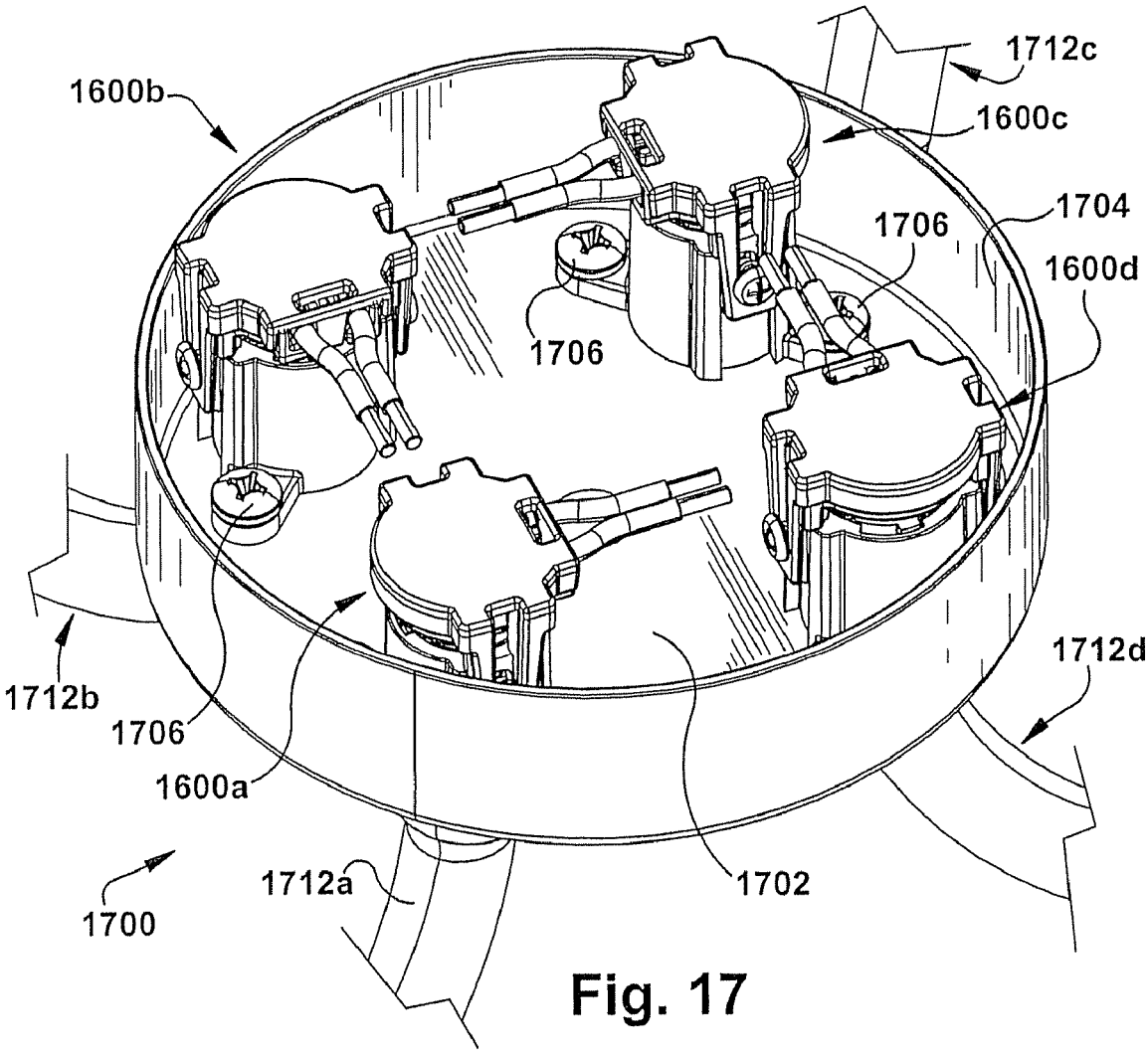
FIG. 17 is a portion of an exemplary fixture having a plurality of bottom-mount sockets of FIG. 16.

FIGS. 15 and 16 show two different mounting configurations for exemplary two-piece electrical contact retainer 1456. FIG. 15 shows an exemplary socket 1500 formed with exemplary two-piece electrical contact retainer 1456 with an exemplary socket housing 1536' having one or more mounting tabs 1502 (two mounting tabs 1502 in the illustrated embodiment) having openings 1504 for side mounting to a wiring body. FIG. 16 shows an exemplary socket 1600 formed with exemplary two-piece electrical contact retainer 1456 with exemplary socket housing 1536" having mounting tabs 1502, 1604 having openings 1606, 1608 for top/bottom mount to a wiring body. Exemplary socket housing 1536' has first and second ridges 1520, 1522 forming a channel 1524 accepting aligned projections 1422, 1424 of two-piece electrical contact retainer 1456. Similarly, exemplary socket housing 1536" has first and second ridges 1620, 1622 forming a channel 1624 accepting aligned projections 1422, 1424 of two-piece electrical contact retainer 1456. FIG. 17 shows a portion of an exemplary fixture 1700 having a plurality of bottom-mount sockets 1600 of FIG. 16. The sockets 1600 are mounted to a bottom wall 1702 of wiring body 1704 by fasteners 1706 with a portion (1699 in FIG. 16) extending through openings (not shown) in wiring body 1704. Arms 1712 are connected to the wiring body 1704 via arm plugs (e.g., plug 20, above) coupled to the sockets 1600.

Figure 18:
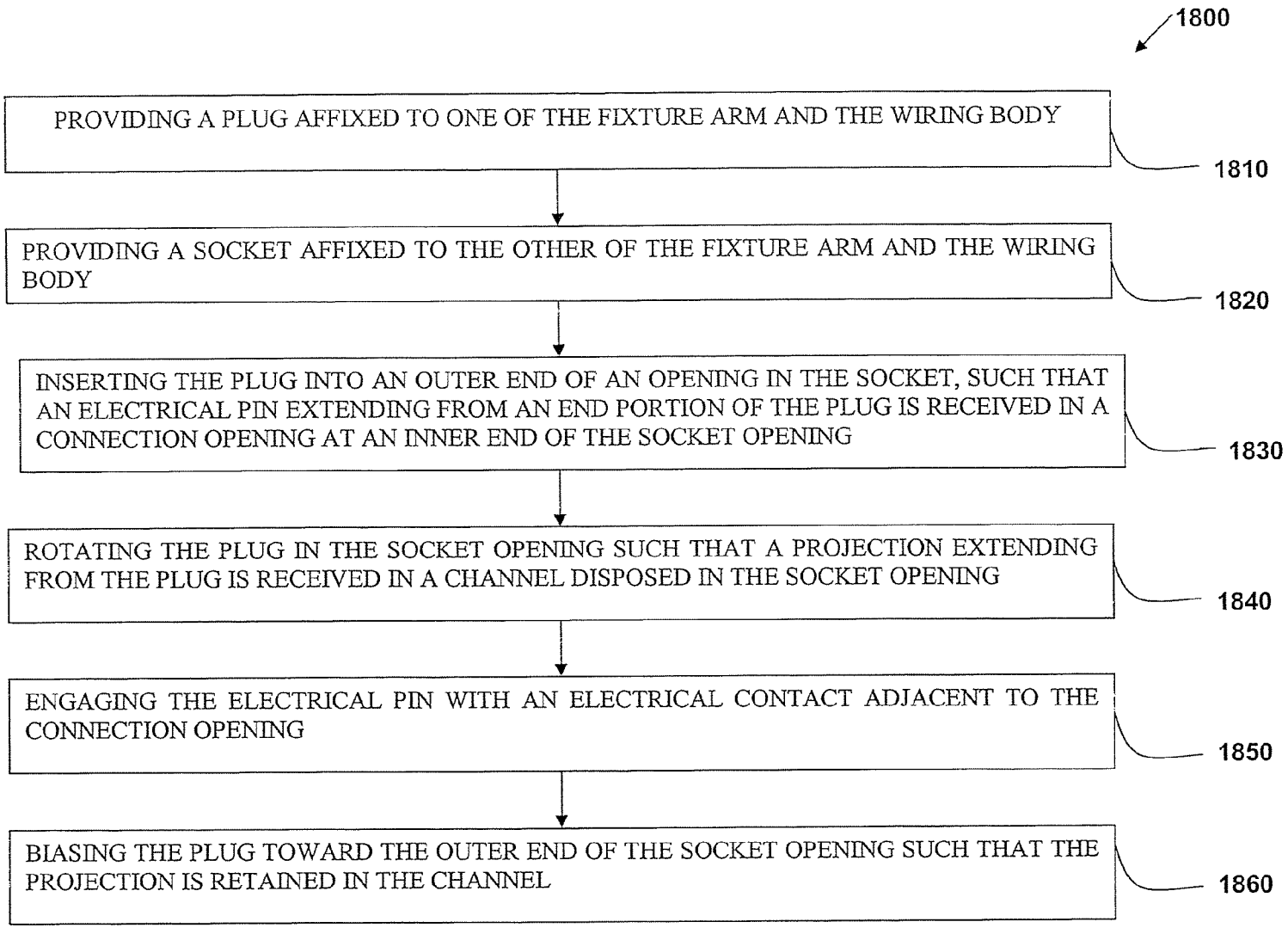
FIG. 18 illustrates an exemplary method of electrically and mechanically connecting a detachable fixture arm to a wiring body.

In an exemplary method 1800 of electrically and mechanically connecting a detachable fixture arm to a wiring body, as shown in FIG. 18, a plug is provided affixed to one of the fixture arm and the wiring body (block 1810), and a socket is provided affixed to the other of the fixture arm and the wiring body (block 1820). The plug is inserted into an outer end of an opening of the socket such that an electrical pin extending from an end portion of the plug is received in a connection opening at an inner end of the socket opening (block 1830). The plug is rotated in the socket opening such that the projection is received in a channel disposed in the socket opening (block 1840), as shown, for example, in FIGS. 5A-E. The electrical pin is engaged with an electrical contact adjacent to the connection opening (block 1850). The plug is biased toward the outer end of the socket opening such that the projection is retained in the channel (block 1860).

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. For example, the connectors described herein may be used with KD arms of lighting portables as well as lighting fixtures. As another example, the connectors herein may be used with virtually any wiring body, such as, for example, the tube or base of a lamp or torchiere, wall-mount wiring bodies of wall sconces, etc. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated. Additionally, from a structural standpoint, the appended claims, or any combination of the appended claims, may be applied to, or thought of as depending from all of the other claims, except where such dependency may be impossible. An example of such claim dependency is included in co-pending and concurrently filed Canadian Application, filed under attorney matter number 24259-04616, the disclosure of which is hereby incorporated by reference in its entirety.

What is claimed is:

1. An arrangement for electrically and mechanically coupling a lighting fixture arm to a lighting fixture wiring body, the arrangement comprising:

a lighting fixture arm;

a lighting fixture wiring body;

a socket, affixed to one of the fixture arm and the wiring body, the socket comprising:

a socket opening having an outer end, an inner end, and a first mating portion on an internal surface of the socket opening; and at least one socket electrical contact; and a plug, affixed to the other of the fixture arm and the wiring body, the plug comprising:

a plug body having an end portion and a side portion;

a second mating portion, disposed on the side portion of the plug body, the second mating portion being configured to engage the first mating portion when the plug is coupled with the socket; and at least one plug electrical contact disposed on the plug body; and wherein when the plug is inserted in the socket, the plug and the socket are configured such that the plug is rotatable from an inserted position to a retained position in which the at least one plug electrical contact engages the at least one socket electrical contact to electrically couple the arm to the wiring body and the first mating portion is retained in engagement with the second mating portion to mechanically couple the arm to the wiring body.

2. The arrangement of claim 1, wherein one of the first and second mating portions comprises at least one projection, and the other of the first and second mating portions comprises at least one channel accepting the at least one projection.

3. The arrangement of claim 2, further comprising a resilient member disposed at the inner end of the socket opening, wherein the resilient member biases the at least one projection against the at least one channel when the plug is in the retained position, thereby permitting the plug to be inserted into the socket, pushed against the resilient member, turned, and released into the retained position.

4. The arrangement of claim 3, wherein the resilient member is a spring plate.

5. The arrangement of claim 2, wherein the at least one channel comprises a locking portion, disposed at least partially axially along the internal surface of the socket opening, wherein the at least one projection is retained within the locking portion of the at least one channel when the plug is in the retained position.

6. The arrangement of claim 2, wherein the at least one channel comprises a receiving portion disposed at least partially axially along the internal surface of the socket opening, wherein the at least one projection is received within the receiving portion when the plug is in the inserted position.

7. The arrangement of claim 2, wherein the at least one channel comprises:

a locking portion, disposed at least partially axially along the internal surface of the socket opening, wherein the at least one projection is retained within the locking portion of the at least one channel when the plug is in the retained position;

a receiving portion disposed at least partially axially along the internal surface of the socket opening, wherein the at least one projection is received within the receiving portion when the plug is in the inserted position; and a connecting portion disposed at least partially laterally between the receiving portion and the locking portion, wherein the at least one projection is received within the connecting portion when the plug is rotated from the inserted position to the retained position.

8. The arrangement of claim 2, wherein the at least one channel comprises a J-channel.

9. The arrangement of claim 1, further comprising at least one connection opening disposed at the inner end of the socket opening adjacent to the at least one socket electrical contact, wherein the at least one plug electrical contact comprises at least one electrical pin adapted to be received in the at least one connection opening when the plug body is inserted into the outer end of the socket opening.

10. The arrangement of claim 9, wherein the socket comprises a socket housing defining the socket opening, and the socket further comprises a contact retainer assembled to the socket housing at the inner end of the socket opening, wherein the at least one socket electrical contact and the at least one connection opening are disposed on the contact retainer.

11. The arrangement of claim 10, wherein the contact retainer comprises first and second retaining components which cooperate to retain the at least one socket electrical contact.

12. The arrangement of claim 10, wherein the contact retainer comprises at least one mounting flange having an opening adapted to align with a corresponding opening in an outer surface of the socket housing for assembling the contact retainer to the socket housing.

13. The arrangement of claim 1, wherein the socket further comprises at least one mounting tab for affixing the socket to the one of the fixture arm and the wiring body.

14. The arrangement of claim 1, wherein the plug is affixed to the fixture arm, and the fixture arm further comprises a lighting socket and electrical wiring electrically connecting the at least one plug electrical contact to the lighting socket and wherein the socket is affixed to the wiring body, and the wiring body further comprises electrical wiring connected to the socket for electrically connecting the wiring body to an external power source.

15. The arrangement of claim 1, wherein the socket comprises a socket housing defining the socket opening, and the socket further comprises a contact retainer assembled to the socket housing at the inner end of the socket opening, wherein the at least one electrical contact is disposed on the contact retainer.

16. The arrangement of claim 1, wherein the rotational difference between the inserted position and the retained position is between approximately 5° and approximately 10°.

17. The arrangement of claim 1, wherein the first mating portion comprises two channels and the second mating portion comprises two projections.

18. The arrangement of claim 1, wherein the plug comprises two plug electrical contacts and the socket comprises two socket electrical contacts.

19. The arrangement of claim 1, wherein the at least one plug electrical contact is flexed against the at least one socket electrical contact when the plug is in the retained position.

20. The arrangement of claim 1, wherein the plug electrical contact engages a curved portion of the socket electrical contact when the plug is in the retained position.

21. The arrangement of claim 1, wherein the at least one plug electrical contact comprises an electrical pin, and the at least one socket electrical contact comprises a structure having first and second perpendicular legs; a curved contacting portion extending laterally from the first leg for engaging the at least one plug electrical contact; and an electrical connection portion extending longitudinally from the second leg for attaching the at least one socket electrical contact with electrical wiring; wherein the at least one socket electrical contact is assembled to a rear side of a contact retainer, the contact retainer being assembled to the inner end of the socket opening, such that the curved contacting portion extends into a connection opening in the contact retainer for receiving the electrical pin.

22. The arrangement of claim 1, wherein the plug further comprises a cavity in the end portion and a contact retainer shaped to be accepted by and held by the cavity, the contact retainer having at least one opening for holding the at least one plug electrical contact.

23. The arrangement of claim 1, wherein the first mating portion comprises two J-channels and the second mating portion comprises two projections, each J-channel accepting a corresponding projection.

24. The arrangement of claim 1, wherein:

the second mating portion comprises at least one projection;

the first mating portion comprises at least one channel, comprising:

a locking portion, disposed at least partially axially along the internal surface of the socket opening, wherein the at least one projection is retained within the locking portion of the at least one channel when the plug is in the retained position;

a receiving portion disposed at least partially axially along the internal surface of the socket opening, wherein the at least one projection is received within the receiving portion when the plug is in the inserted position; and a connecting portion disposed at least partially laterally between the receiving portion and the connection portion, wherein the at least one projection is received within the connecting portion when the plug is rotated from the inserted position to the retained position;

the at least one plug electrical contact comprises at least one electrical pin extending from the plug body;

the socket comprises:

a spring plate disposed at the inner end of the socket opening, wherein the at least one projection is receivable in the connecting portion of the at least one channel when the plug is inserted in the socket and pressed against the spring plate, and further wherein the spring plate biases the at least one projection against the locking portion of the at least one channel when the plug is in the retained position;

at least one connection opening disposed at the inner end of the socket opening adjacent to the at least one socket electrical contact, wherein the at least one electrical pin is configured to be received in the at least one connection opening when the plug body is inserted into the outer end of the socket opening;

at least one mounting tab for affixing the socket to the one of the fixture arm and the wiring body;

a socket housing defining the socket opening;

a contact retainer assembled to the socket housing at the inner end of the socket opening, wherein the at least one socket electrical contact and the at least one connection opening are disposed on the contact retainer, and further wherein the contact retainer comprises: first and second retaining portions which cooperate to retain the at least one socket electrical contact, and at least one mounting flange having an opening adapted to align with a corresponding opening in an outer surface of the socket housing for assembling the contact retainer to the socket housing;

the plug comprises a cavity in the end portion and a contact retainer shaped to be held by the cavity, the contact retainer comprising at least one opening for holding the at least one plug electrical contact; and wherein the plug is affixed to the fixture arm, and the fixture aim further comprises a lighting socket and electrical wiring electrically connecting the at least one electrical pin to the lighting socket and wherein the socket is affixed to the wiring body;

wherein the wiring body further comprises electrical wiring connected to the socket for electrically connecting the wiring body to an external power source; and wherein the rotational difference between the inserted position and the retained position is between approximately 5° and approximately 10°.

25. The arrangement of claim 24, wherein the socket comprises two connection openings and a first mating portion comprising two channels, and the plug comprises two plug electrical contacts, and a second mating portion comprising two projections.

26. A method of electrically and mechanically connecting a detachable fixture arm to a wiring body, the method comprising:

providing a plug affixed to one of the fixture arm and the wiring body;

providing a socket affixed to the other of the fixture arm and the wiring body;

inserting the plug into an outer end of an opening of the socket such that an electrical pin extending from an end portion of the plug is received in a connection opening at an inner end of the socket opening;

rotating the plug in the socket opening such that a projection extending from the plug is received in a channel disposed in the socket opening, and the electrical pin engages an electrical contact adjacent to the connection opening; and biasing the plug toward the outer end of the socket opening such that the projection is retained in the channel.

* * * * *

UNITED STATES PATENT AND TRADEMARK OFFICE

CERTIFICATE OF CORRECTION

PATENT NO. : 7,387,522 B2
APPLICATION NO. : 11/470411
DATED : June 17, 2008
INVENTOR(S) : Joseph John Janos et al.

It is certified that error appears in the above-identified patent and that said Letters Patent is hereby corrected as shown below:

Column 13, line 31, please delete “aim” and insert -- arm --.

Signed and Sealed this

Twelfth Day of August, 2008

JON W. DUDAS
*Director of the United States Patent and Trademark Office*